US008091812B2

(12) United States Patent
Abramson et al.

(10) Patent No.: US 8,091,812 B2
(45) **Date of Patent: *Jan. 10, 2012**

(54) SHREDDER HEAD ADAPTED TO SHRED DATA BEARING DOCUMENTS AND BOTTLES

(76) Inventors: Aron Abramson, Brooklyn, NY (US); Charles Sued, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/938,580

(22) Filed: Nov. 3, 2010

(65) Prior Publication Data

US 2011/0042494 A1 Feb. 24, 2011

Related U.S. Application Data

(63) Continuation of application No. 12/196,309, filed on Aug. 22, 2008, which is a continuation-in-part of application No. 11/861,645, filed on Sep. 26, 2007, now Pat. No. 7,819,351.

(51) Int. Cl.
*B02C 18/22* (2006.01)

(52) U.S. Cl. ..... 241/99; 241/100

(58) Field of Classification Search ..... 241/30, 241/99, 100
See application file for complete search history.

(56) References Cited

U.S. PATENT DOCUMENTS

| | | | | |
|---|---|---|---|---|
| 5,035,367 | A * | 7/1991 | Nojima | 241/37.5 |
| 5,904,305 | A * | 5/1999 | Kaczmarek | 241/79.1 |
| 6,250,576 | B1 * | 6/2001 | Harada | 241/79.1 |
| 6,827,304 | B2 * | 12/2004 | Rousseau | 241/73 |
| 7,819,351 | B2 | 10/2010 | Sued et al. | |
| 7,823,814 | B2 | 11/2010 | Sued et al. | |

* cited by examiner

*Primary Examiner* — Faye Francis
(74) *Attorney, Agent, or Firm* — Garcia-Zamor IP Law; Ruy M. Garcia-Zamor

(57) ABSTRACT

A method of shredding bottles preferably, but not necessarily, including providing a major blade rotatably located about a common axis with at least some of the plurality of shredder blades. The major blade may have at least one shaft which extends radially outwardly from the common axis for a distance greater than the maximum radius of any of the plurality of shredder blades. Preferably engaging bottles via the major blade prior to the commencement of cutting by the plurality of shredder blades so that the major blade preferably at least one of cutting, deforming, and dragging bottles toward the plurality of shredder blades for shredding thereof.

14 Claims, 20 Drawing Sheets

FIG. 20
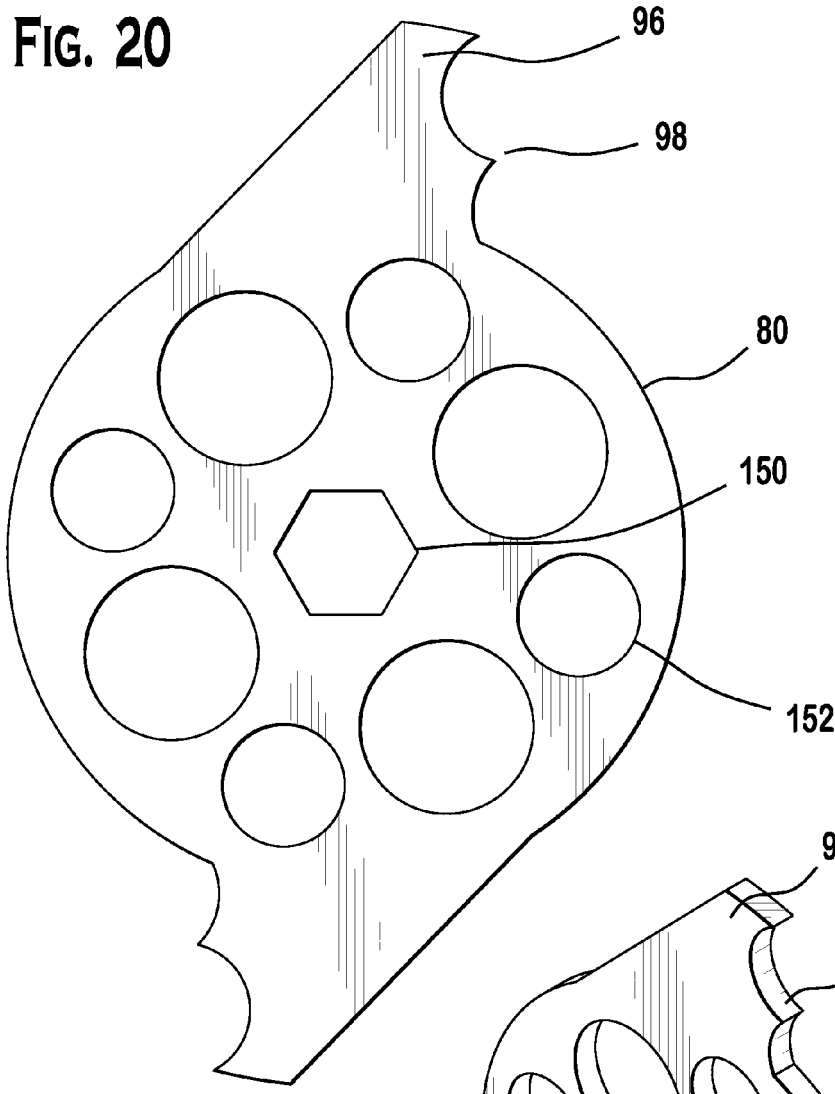
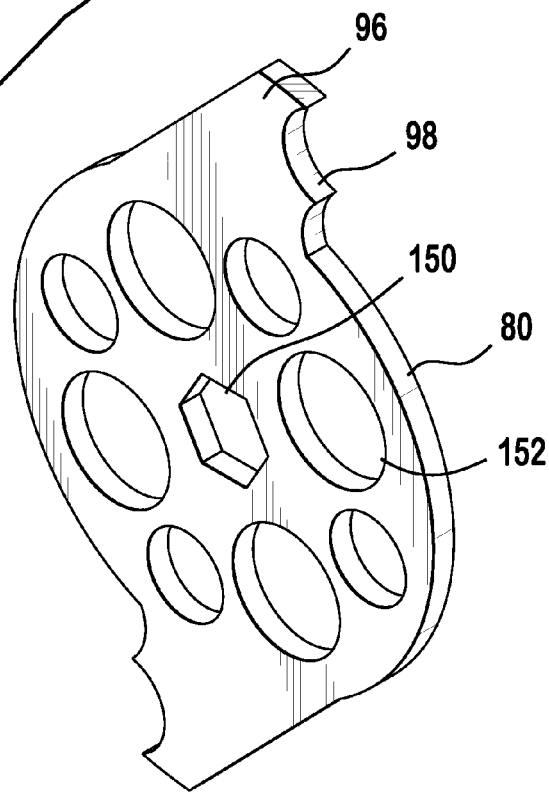
FIG. 21

SHREDDER HEAD ADAPTED TO SHRED DATA BEARING DOCUMENTS AND BOTTLES

CROSS REFERENCE TO RELATED APPLICATION

This application is a continuation of and claims priority to U.S. patent application Ser. No. 12/196,309, filed on Aug. 22, 2008 which is a continuation-in-part of and claims priority to U.S. patent application Ser. No. 11/861,645, filed on Sep. 26, 2007, now U.S. Pat. No. 7,819,351 each of the above-identified applications is hereby incorporated by reference herein as if set forth in its entirety.

BACKGROUND

The present invention is generally directed to shredders and, more specifically, to a shredder adapted to shred data bearing documents and bottles.

Conventional shredders shred office documents, receipts, credit cards, CDs, DVDs, and the like to protect personal information from third parties. However, personal data is often located on bottles, such as prescription bottles, that cannot be disposed of using conventional shredders.

It would be advantageous to provide a shredder that can also shred bottles and a method of doing the same.

SUMMARY

Briefly speaking, one embodiment of the present invention is directed to a shredder head adapted to shred data bearing documents and bottles. The shredder head includes a shredder head housing including a housing section that is moveable between first and second housing section positions. When the housing section is in the first housing section position the shredder head is adapted to receive data bearing documents to be shredded. When the housing section is in the second housing section position, a volume is defined within the housing section that is adapted to contain a bottle for shredding. A plurality of shredder blades are disposed within the shredder head housing and are adapted to shred material inserted therein.

In a separate aspect, one embodiment of the present invention is directed to a shredder head adapted to shred data bearing documents and bottles. The shredder head includes a shredder head housing that defines a slot. The shredder head housing being configurable to orient the slot in first and second slot configurations. When the shredder head housing is configured so that the slot is oriented in the first slot configuration the shredder head is adapted to receive data bearing documents to be shredded. When the shredder head housing is configured so that the slot is oriented in the second slot configuration the shredder head is adapted to receive a bottle for shredding. A plurality of shredder blades are disposed within the shredder head housing and adapted to shred material inserted in the slot.

In a separate embodiment, one embodiment of the present invention is directed to a shredder head adapted to shred data bearing documents and bottles. The shredder head including a shredder head housing defining a slot therein. A plurality of shredder blades are disposed within the shredder head housing and adapted to shred material inserted therein. The shredder head housing is configurable to shred data bearing documents and bottles.

In a separate embodiment, one embodiment of the present invention is directed to a method of shredding material. The method including the steps of: providing a shredder defining at least one slot for receiving material. The shredder including a plurality of shredder blades adapted to shred the material inserted into the at least one slot. The shredder being configurable to shred data bearing documents and bottles.

In a separate aspect, one embodiment of the present invention is directed to a shredder head. The shredder head includes a shredder head housing which is configured to receive data bearing documents to be shredded and additionally configured to receive a bottle for shredding. The shredder head also includes a plurality of shredder blades which are disposed within the shredder head housing and are adapted to shred data bearing documents received by the shredder head housing and bottles received by the shredder head housing.

In a separate aspect, one embodiment of the present invention is directed to a shredder head adapted to at least shred bottles. The shredder head includes a shredder head housing which defines a shredder cavity and an opening adapted to receive a bottle for shredding for placement into the shredder cavity. The shredder head also includes a plurality of shredder blades which are disposed within the shredder head housing and adapted to shred material inserted into the shredder cavity. The plurality of shredder blades includes a majority of shredder blades which have a generally similar radius, and also includes at least one major blade. Each major blade includes at least one shaft extending generally radially outwardly for a distance greater than the maximum radius of any of the majority of shredder blades. The shredder head further includes at least one grate oriented below the plurality of shredder blades. Each grate includes a mounting section and a sorting section. The sorting section defines a plurality of holes therethrough and is located in close proximity to the plurality of shredder blades. The sorting section of each grate is configured to prevent larger pieces of shredded material from passing through the grate. The at least one grate defines at least one grate gap which allows passage of the at least one shaft of the at least one major blade during rotation.

In a separate aspect, one embodiment of the present invention is directed to a shredder head adapted to at least shred bottles. The shredder head includes a shredder head housing which defines a shredder cavity and an opening adapted to receive a bottle for shredding for placement into the shredder cavity. The shredder head also includes a plurality of shredder blades which are disposed within the shredder head housing. The plurality of shredder blades include a majority of shredder blades which have a generally similar radius, and also include at least one major blade. Each of the at least one major blade includes at least one shaft which extends generally radially outwardly for a distance greater than the maximum radius of any of the majority of shredder blades. The at least one major blade is adapted to engage a bottle which has been placed into the shredder cavity prior to the beginning of the shredding of the bottle by the majority of shredder blades.

In a separate aspect, one embodiment of the present invention is directed to a shredder head adapted to at least shred bottles. The shredder head includes a shredder head housing which defines a shredder cavity and an opening adapted to receive a bottle for shredding for placement into the shredder cavity. The shredder head also includes a plurality of shredder blades which are disposed within the shredder head housing and are adapted to shred material inserted into the shredder cavity. The shredder head further includes at least one grate oriented below the plurality of shredder blades. Each grate includes a mounting section and a sorting section. The sorting section defines a plurality of holes therethrough and is located in close proximity to the plurality of shredder blades. The sorting section of each grate is configured to prevent larger pieces of shredded material from passing through the grate.

In a separate aspect, one embodiment of the present invention is directed to a method of shredding data bearing documents and bottles. The method includes the steps of: providing a shredder head housing which defines a shredder cavity and an opening adapted to receive a bottle for shredding for placement into the shredder cavity, providing a plurality of shredder blades disposed within the shredder head housing and adapted to shred the material inserted therein, and engaging bottles prior to the commencement of cutting by a majority of shredder blades to at least one of cut, deform, and drag bottles toward the majority of shredder blades for shredding thereof.

In a separate aspect, one embodiment of the present invention is directed to a method of shredding data bearing documents and bottles. The method includes the steps of: providing a shredder head housing configured to receive at least one of a bottle and a data bearing document for shredding, providing a plurality of shredder blades disposed within the shredder head housing and adapted to shred the material inserted therein, engaging bottles prior to the commencement of cutting by a majority of shredder blades to at least one of cut, deform, and drag bottles toward the majority of shredder blades for shredding thereof, and exerting force on the bottle to maintain the bottle in contact with the majority of shredder blades during initial shredding of the bottle.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

Figure 6:
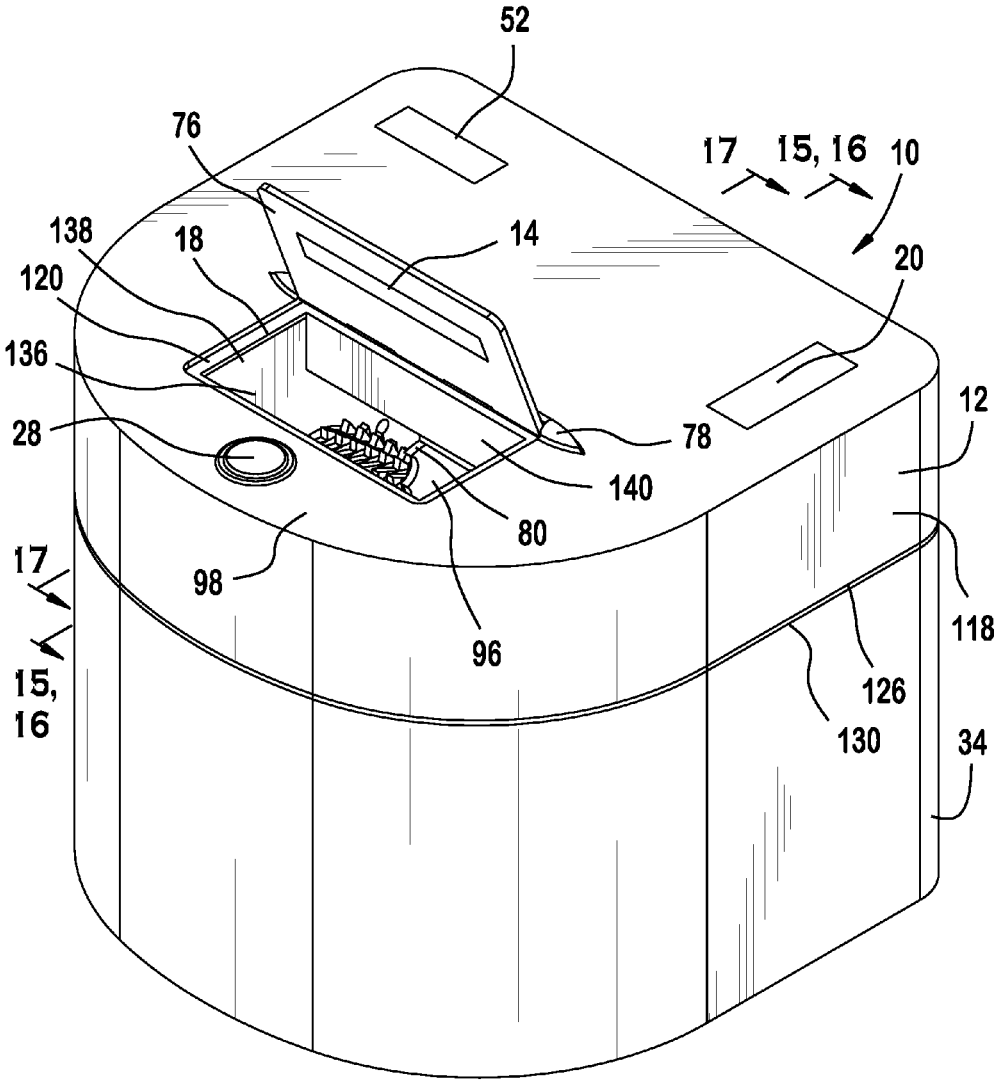
FIG. 6 is a perspective view of a shredder according to a second preferred embodiment of the present invention; The shredder comprises a shredder head and a shredder basket; The shredder head comprises a shredder head housing, and the shredder head housing defines a shredder cavity and an opening for insertion of material to be shredded into the shredder cavity; The shredder head further comprises a shredder cavity door, which is shown in the fully open position; The shredder cavity door may also include a slot(s) for the insertion of material; A plurality of shredder blades are disposed in the shredder cavity; A selectable control is located on the shredder head.
Figure 12:
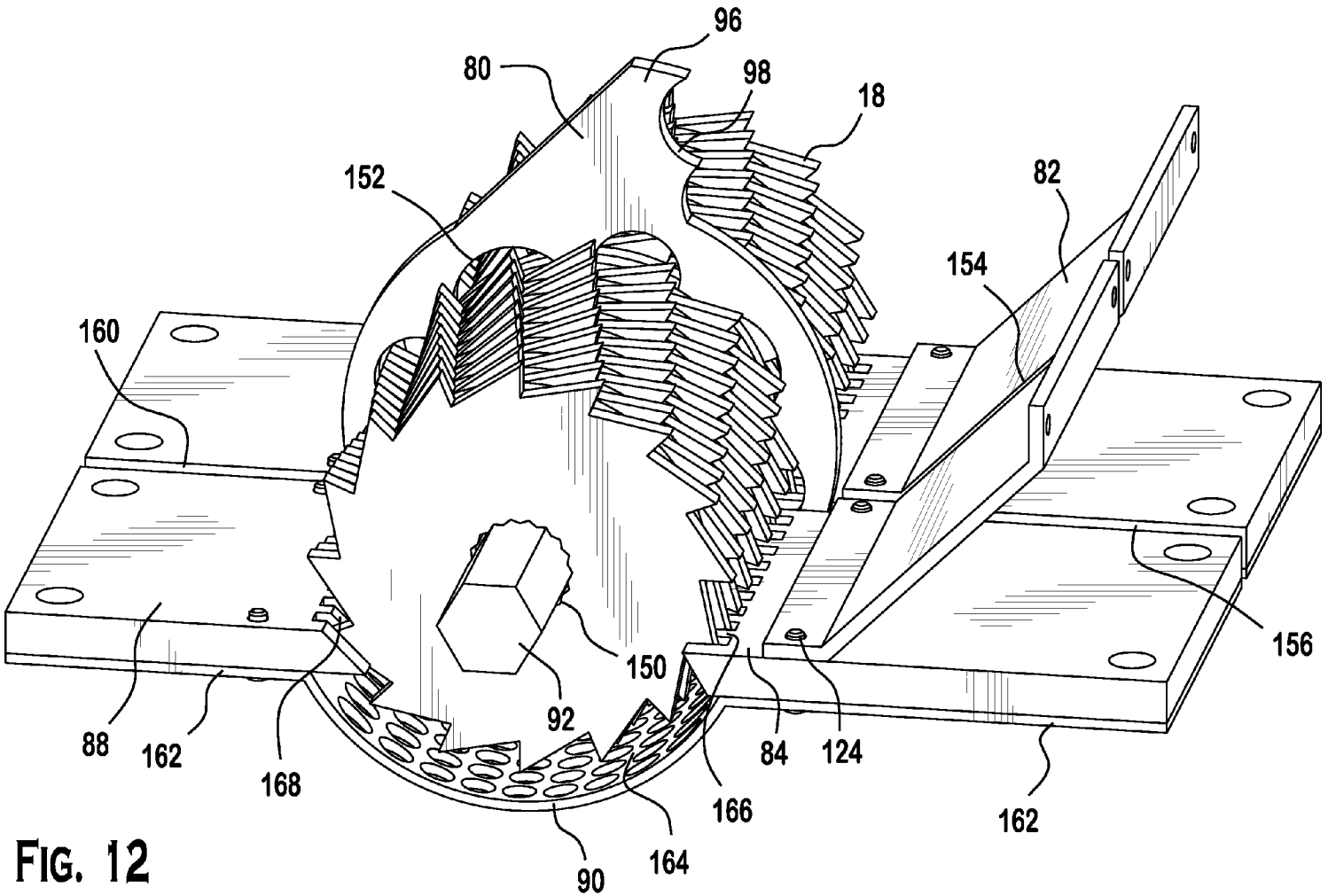
Figure 13:
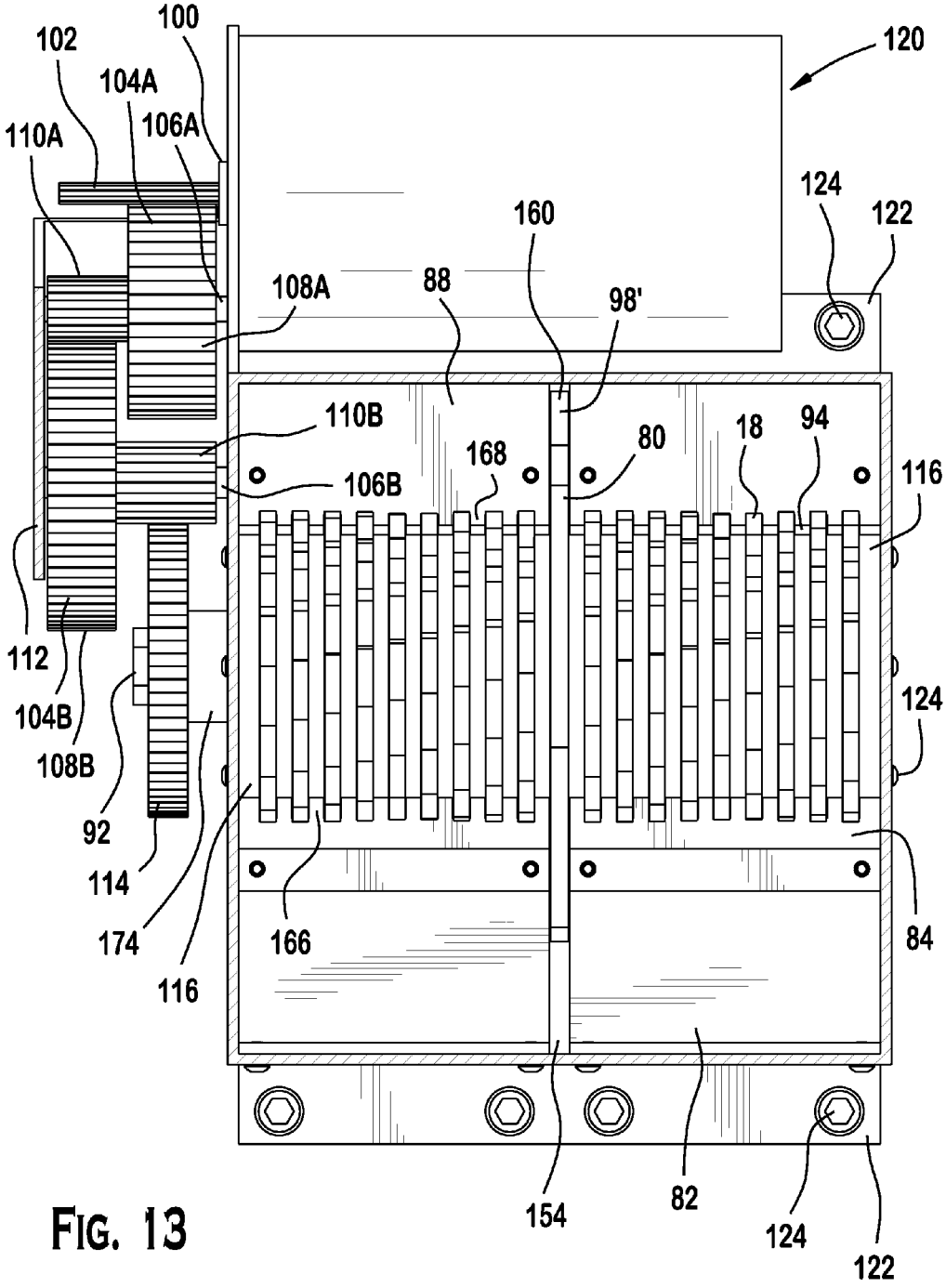
Figure 14:
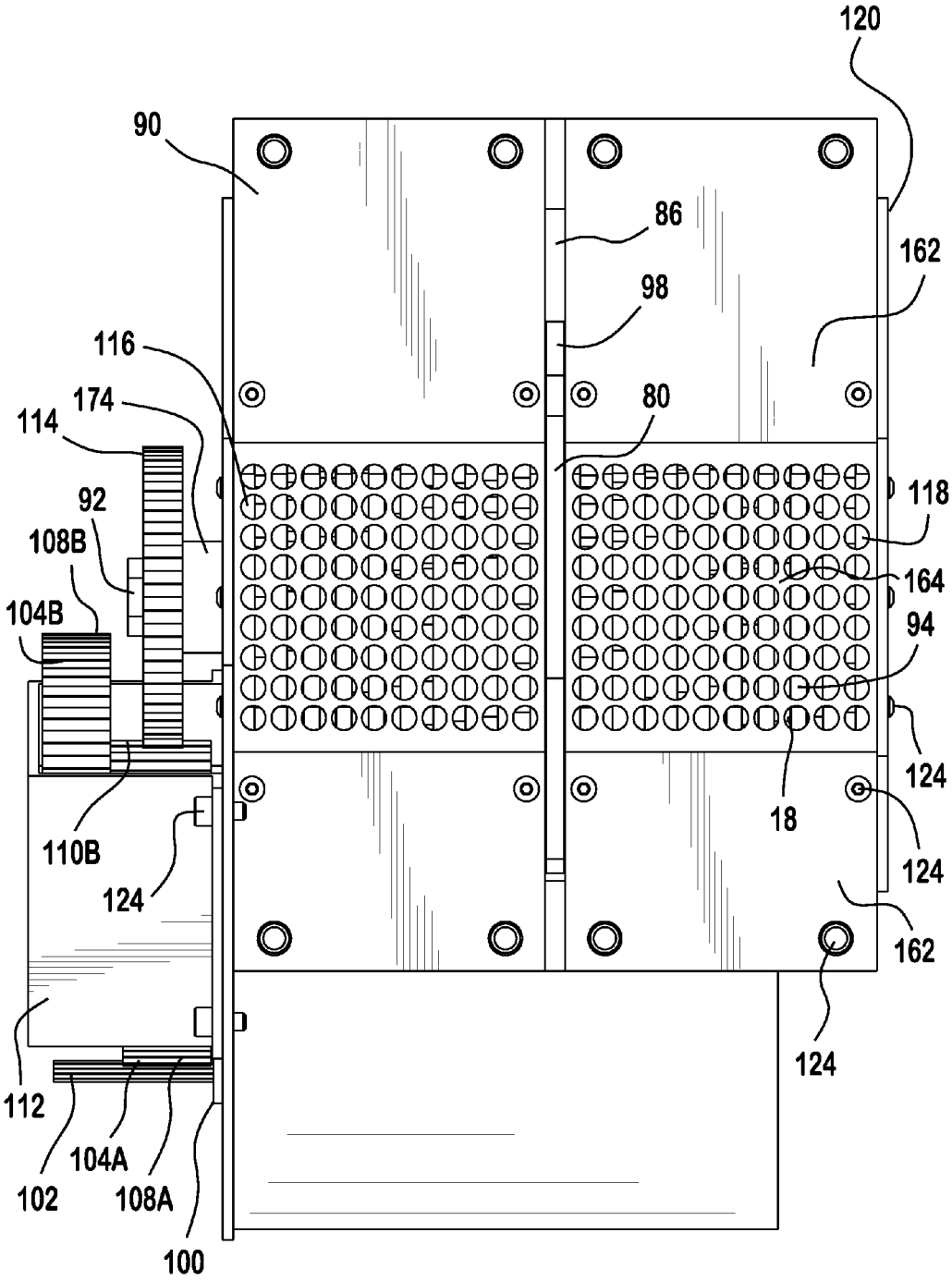
Figure 15:
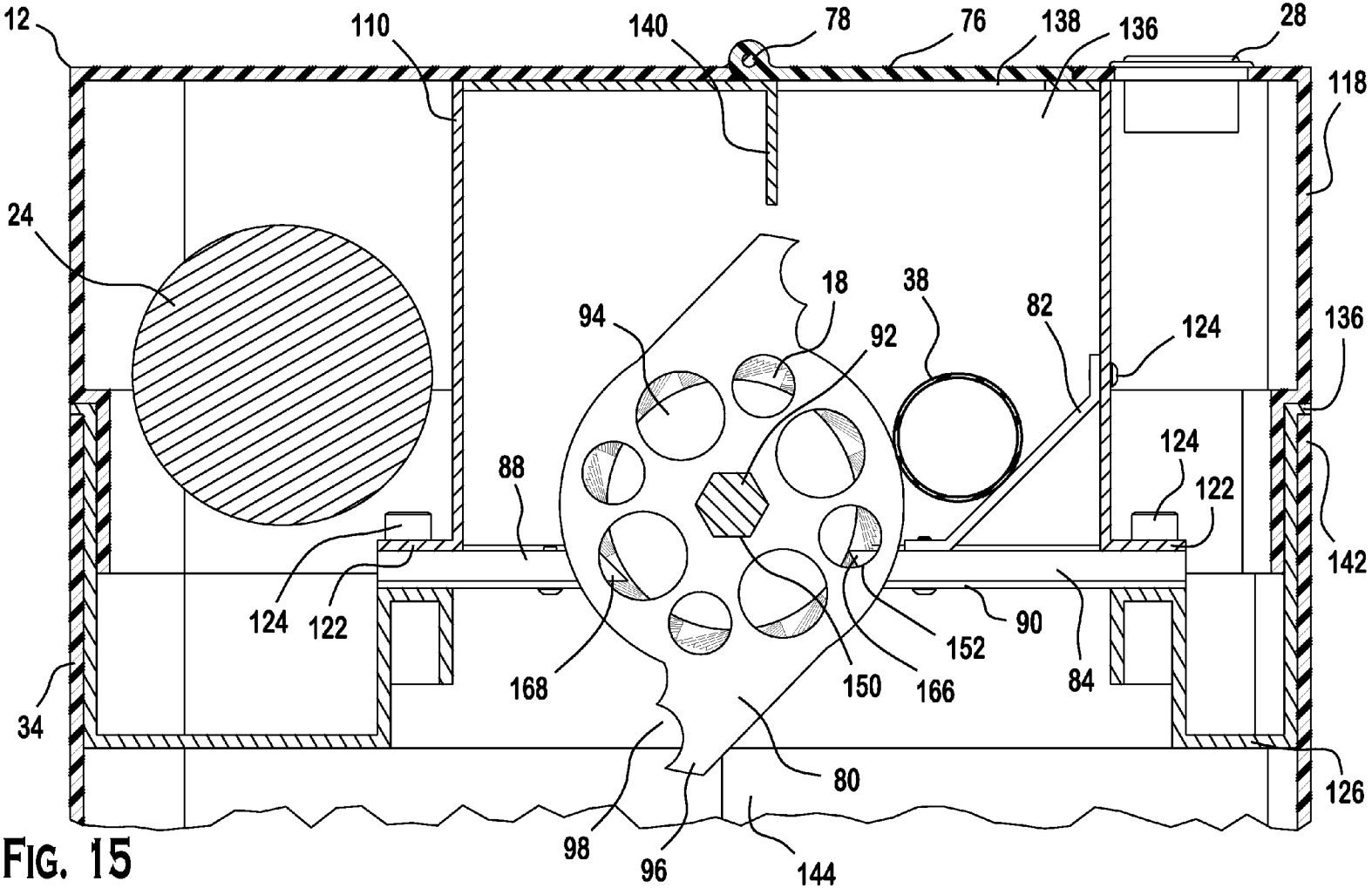
Figure 16:
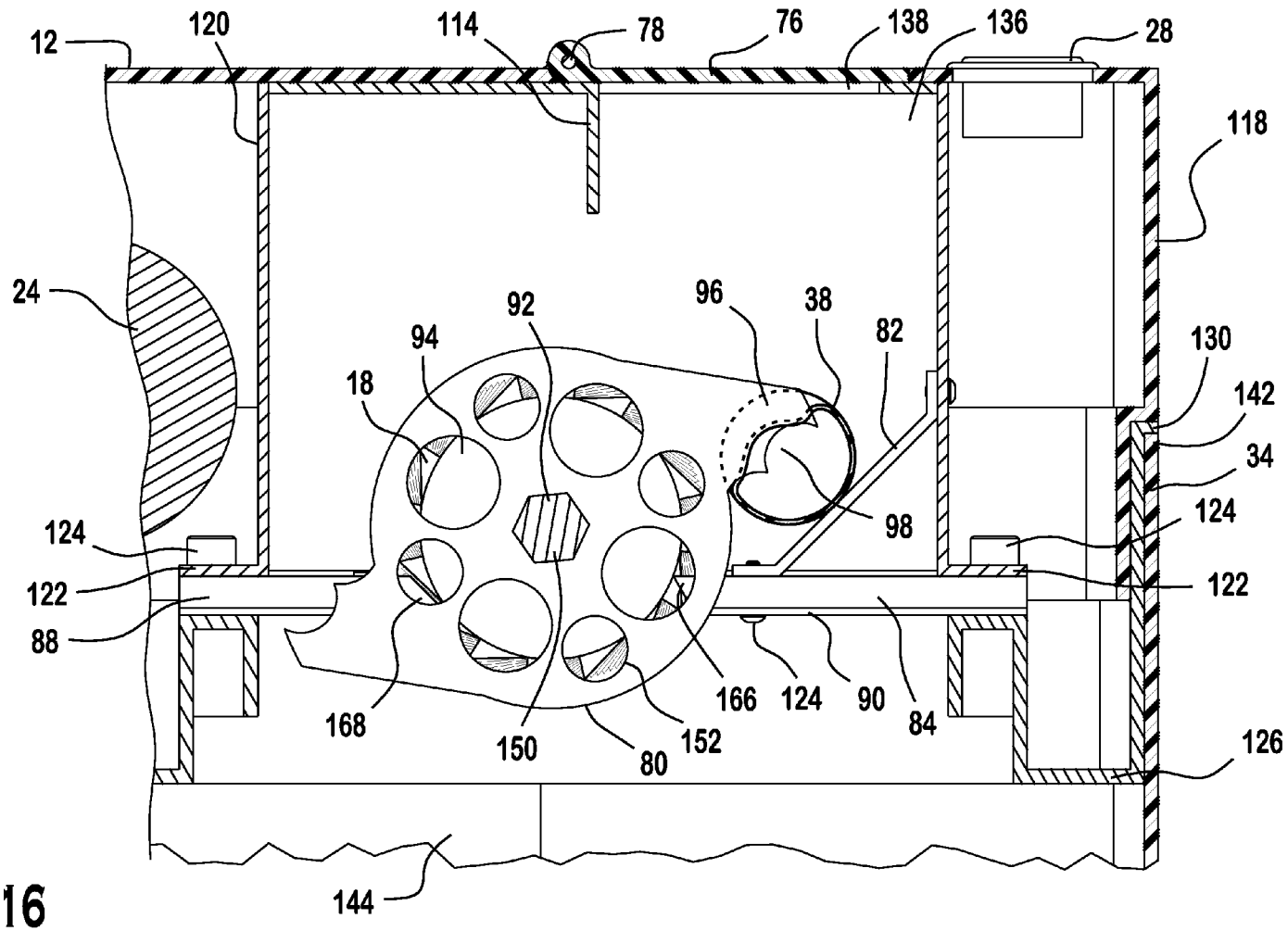
Figure 17:
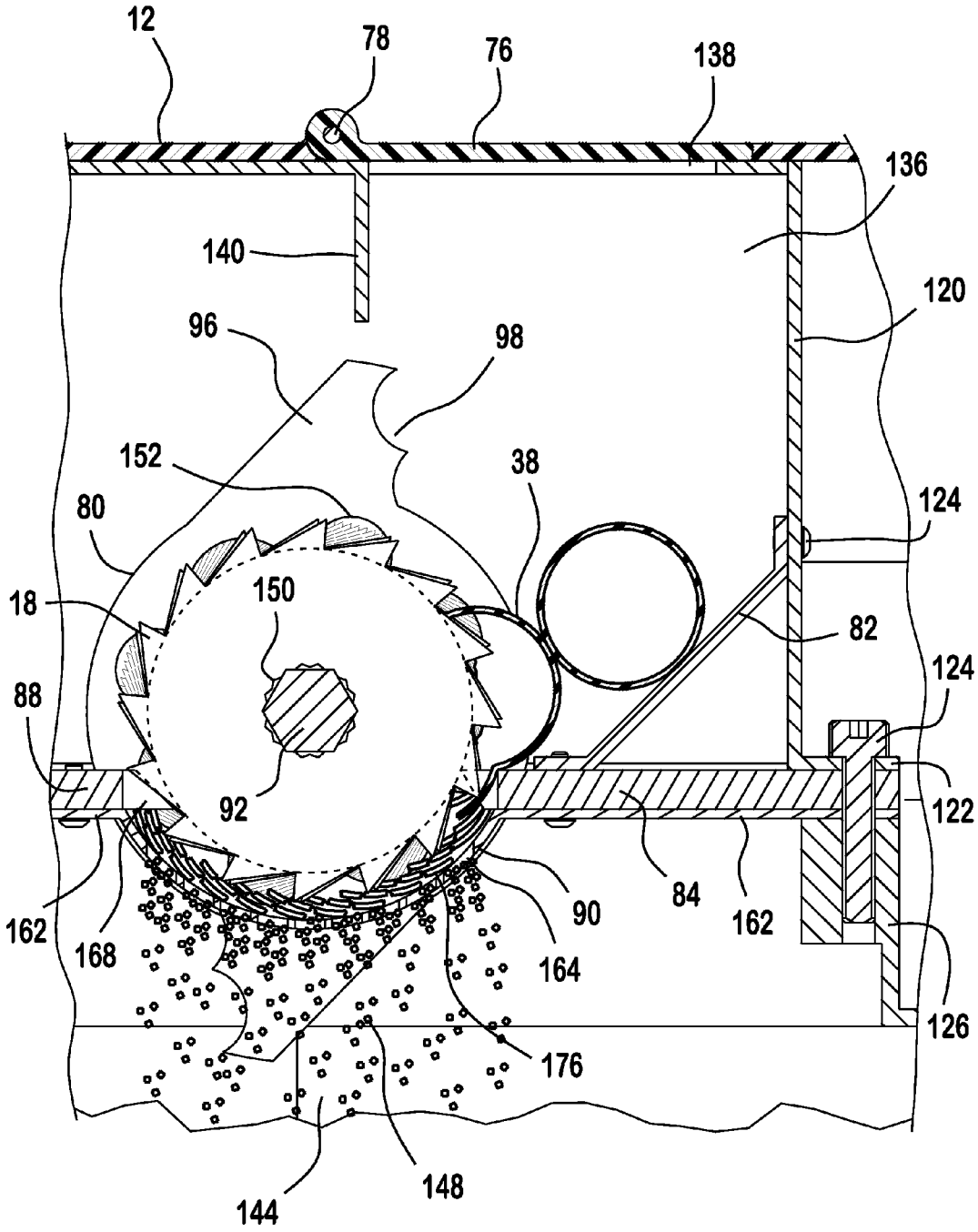
Figure 18:
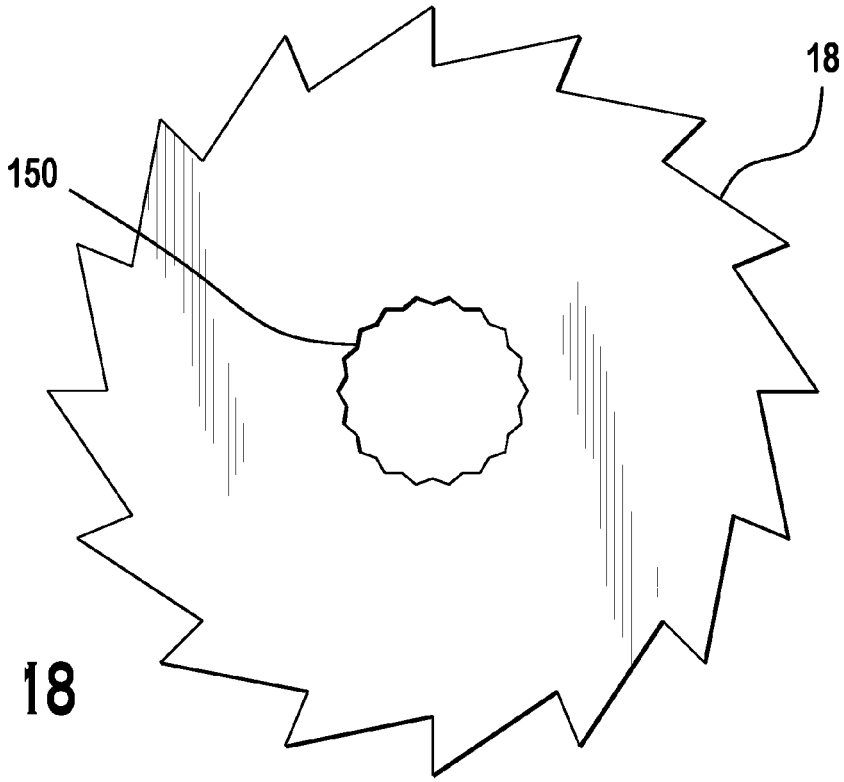
Figure 19:
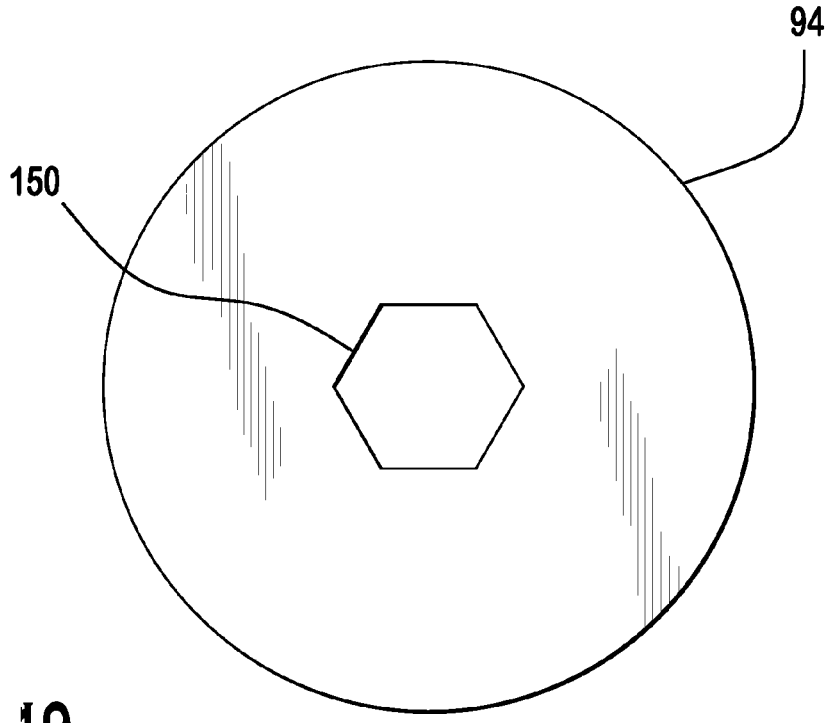
Figure 22:
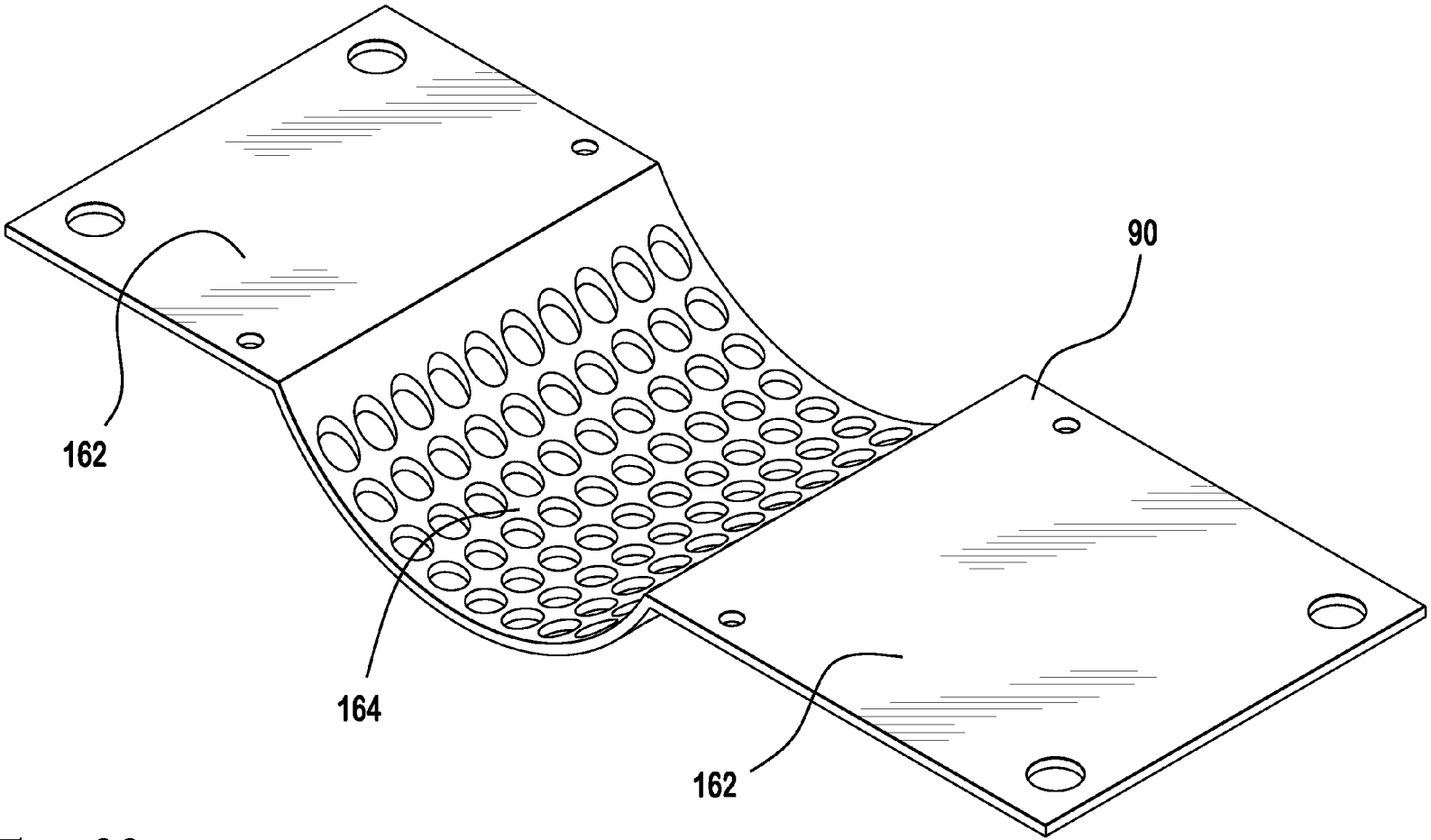

Each of the two brace plates comprises a plurality of brace teeth which are interspersed with at least some of the plurality of shredder blades;

FIG. 12 is a perspective view of the plurality of shredder blades, the shredder blade axle, the two guide plates, the two brace plates, the two grates, and the two stripper plates of the shredder of FIG. 6; Each shredder blade of the majority of the plurality of shredder blades preferably, but not necessarily, passes between two of the plurality of brace teeth, and between two of the plurality of stripper teeth;

FIG. 13 is a top plan, broken away view of the shredder head assembly and the gear bracket in the shredder of FIG. 6; A part of the shredder head housing core has been removed to illustrate a preferred position of the plurality of shredder blades, the two guide plates, the two brace plates, and the two stripper plates within the shredder cavity; The two guide plates preferably define a guide plate gap therebetween, the two brace plates preferably define a brace plate gap therebetween, and the two stripper plates preferably define a stripper plate gap therebetween, and each gap allows passage of the two shafts of the major blade; Each of the two stripper plates preferably includes a plurality of stripper teeth which are interspersed with some of the plurality of shredder blades;

FIG. 14 is a bottom plan view of the shredder head assembly and the gear bracket in the shredder of FIG. 6; The preferred two grates may define a grate gap therebetween which allows passage of the two shafts of the major blade;

FIG. 15 is a cross-sectional view of the shredder of FIG. 6 as taken along the line 15-15 in FIG. 6; A bottle to be shredded is illustrated in its position after being inserted through the shredder cavity opening into the shredder cavity, but prior to action of the major blade to initiate shredding of the bottle;

FIG. 16 is a cross-sectional view of a part of the shredder of FIG. 6 as taken along the line 15-15 in FIG. 6; A bottle to be shredded is illustrated in its position after it has been engaged by the major blade, but prior to its contact with the majority of the plurality of shredder blades;

FIG. 17 is a cross-sectional view of a part of the shredder of FIG. 6 as taken along the line 17-17 in FIG. 6; A bottle is shown partially shredded after it has contacted the majority of the plurality of shredder blades; The sorting section of each grate is preferably located in close proximity to the outward radial edges of the majority of the plurality of shredder blades; Pieces of the bottle which are not yet sufficiently small to pass through the sorting section of each grate continue to be shredded by the interaction of the plurality shredder blades and the sorting section of each grate, and any pieces attached to any one of the plurality of shredder blades are removed by the stripper teeth on the stripper plate for further shredding;

FIG. 18 is a side view of one exemplary shredder blade of the majority of the plurality of shredder blades of the shredder of FIG. 6; The shredder blade axle passes through a shredder blade axle bore, and the shape of the shredder blade axle bore allows each shredder blade to be at an angle offset from the closest shredder blades on either side; those of ordinary skill in the art will appreciate from this disclosure that the shredder blade can have any configuration without departing from the scope of the present invention;

FIG. 19 is a side view of one spacer of the shredder of FIG. 6; The shredder blade axle passes through the shredder blade axle bore; those of ordinary skill in the art will appreciate from this disclosure that the spacer can have any configuration without departing from the scope of the present invention;

FIG. 20 is a side view of the preferred major blade of the plurality of shredder blades of the shredder of FIG. 6; Each shaft of the major blade preferably defines an engagement surface which initiates contact with the bottle to be shredded; The shredder blade axle passes through the shredder blade axle bore; those of ordinary skill in the art will appreciate from this disclosure that the major blade can have any configuration without departing from the scope of the present invention;

FIG. 21 is a perspective view of the major blade of the plurality of shredder blades of the shredder of FIG. 6; and FIG. 22 is a perspective view of a grate of the shredder of FIG. 6 which may be used maintain the pieces of the bottle in contact with the at least some of the plurality of shredder blades until the partially shredded pieces are below a predetermined size.

DETAILED DESCRIPTION OF THE PREFERRED EMBODIMENTS

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the shredder and designated parts thereof. The term "data bearing documents", as used in the claims and in corresponding portions of the specification, means "any of articles, paper, documents, office papers, envelopes, receipts, credit cards, identification cards, banking cards, CDs, DVDs, or the like". The term "activated" as used with shredder blades means that the blades are moved in whatever manner results in shredding (i.e., that the blades 18 are operating for shredding). Similarly, the term "deactivated" when used with shredder blades means that the shredder blades are operating for shredding purposes. The term "selectable control", as used in the claims and the corresponding portions of the specification, means "any one of a physical switch, a touch switch, a button, a biometric control, a voice activated switch, a control knob, a remote control switch, or any other known operating mode selection device". The term "activated state", as used with selectable control, means that the selectable control has been manipulated so that the selectable control is set for a particular function. For example, if the selectable control is a simple switch, then the activated state may be having the switch turned to another position and if the selectable control is a touch sensor, then the activated state may be initiated by depressing or touching the sensor in a predetermined manner. The term "biometric selectable control", as used in the claims and in the corresponding portions of the specification, means "any controller that is activated upon detection of specific biometric information via fingerprint scanning, palm scanning, voice recognition, facial recognition, retinal scanning, and the like." The term "fastener", as used in the detailed descriptions of the preferred embodiments, means "any one of a rivet, a screw, a point weld, or an object which maintains a plurality of elements in their relative orientation during placement and operation of the shredder head." The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-22, wherein like numerals indicate like elements throughout, there are shown preferred embodiments of a shredder/shredder head 10 adapted to shred data bearing documents and bottles. Briefly speaking, one embodiment of the shredder 10 includes a shredder head housing 12 defining a slot 14 therein. A plurality of shredder blades 18 are disposed within the shredder head housing 12 and are adapted to shred material inserted therein. The shredder head housing 12 is configurable to shred data bearing documents and bottles. The shredding of bottles, such as prescription bottles or the like, is very advantageous since they often have confidential information printed thereon. The shredder head 10 of the present invention is preferably of the type used in homes, home offices, and offices to shred materials bearing confidential data.

While the preferred shredder head housing 12 has a generally rectilinear shape, those of ordinary skill in the art will appreciate from this disclosure that the shredder head housing 12 can have any shape without departing from the scope of the present invention. The shredder head may also include a bin full indicator 20 or other operational indicators and/or controls. Shredder head handles may be located on the left and right lateral sides of the shredder head housing 12 to allow easy lifting of the shredder head from the shredder basket 34.

The shredder 10 can have a shredder head housing 12 that is placed directly on the shredder basket 34 or similar waste can. Alternatively, a shredder housing 36 may extend generally downwardly from the shredder head housing 12 to slidably receive the shredder basket 34.

The shredder preferably receives power from an outlet via a power conduit, such as an electrical cord, 32. However, the shredder can be powered by batteries or any other suitable power source.

Figure 1:
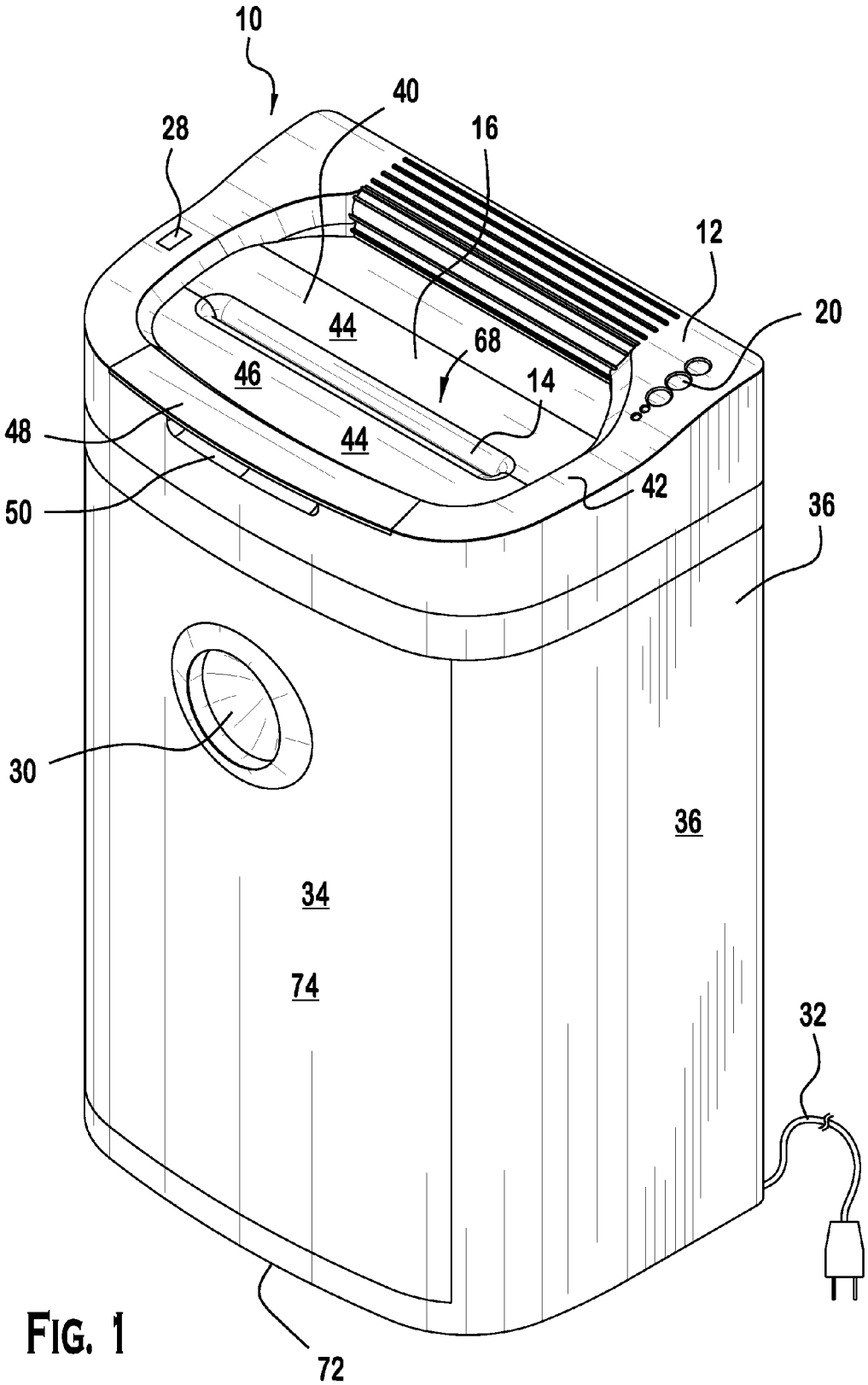
FIG. 1 is a perspective view of a shredder according to the preferred embodiment of the present invention; A housing section defines a slot for receiving material to be shredded; The housing section is moveable between first and second housing positions and is shown in the first housing section position; A selectable control and/or biometric control is located on the shredder head.
Figure 2:
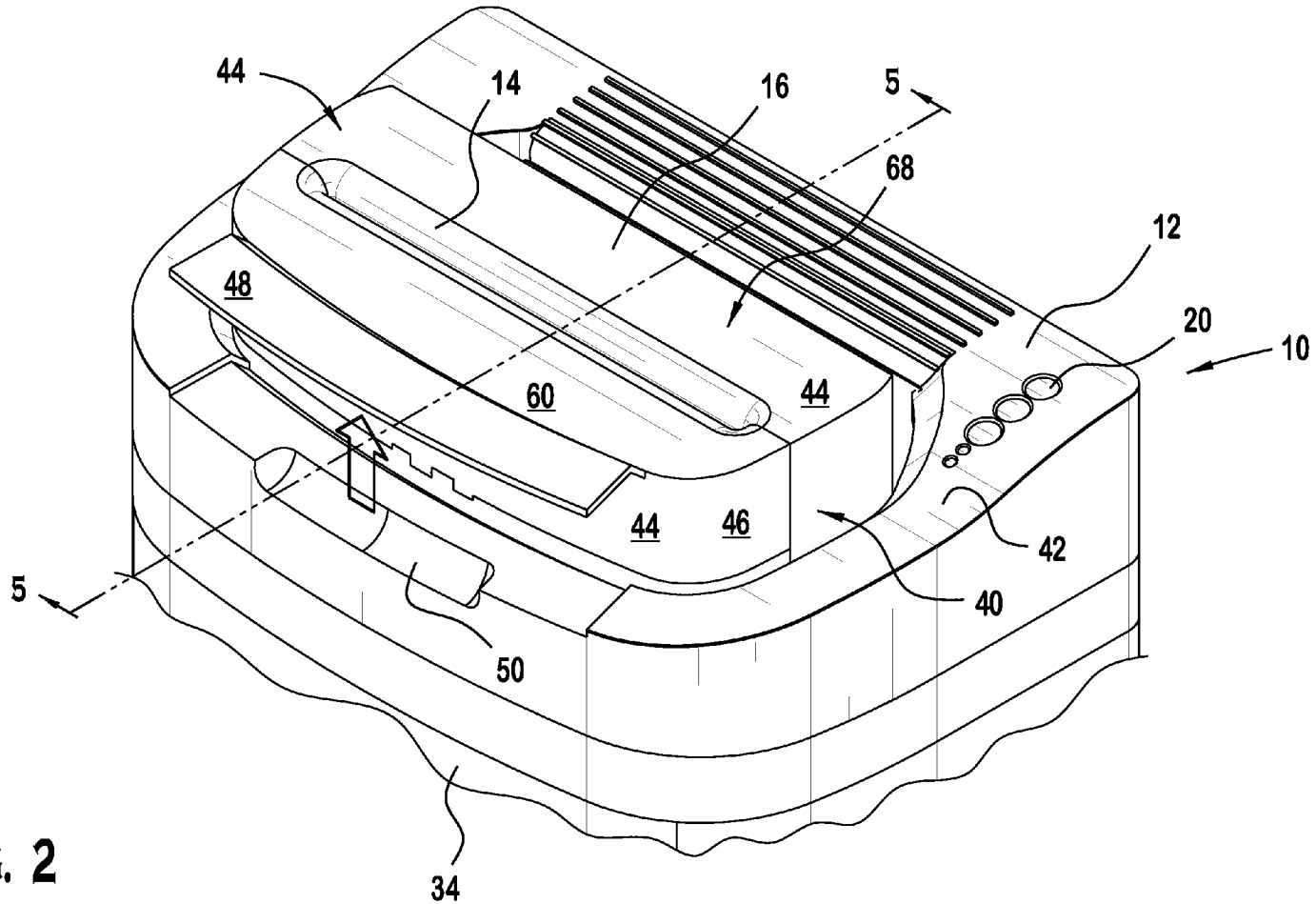
FIG. 2 is a partial, enlarged view of the shredder of FIG. 1 illustrating the housing section in the second housing section position; The housing section is preferably formed by an enclosure that is vertically moveable relative to a remainder of the shredder head housing.

Referring to FIGS. 1 and 2, one preferred embodiment of the shredder head 10 of the present invention includes a shredder head housing 12. The shredder head housing 12 includes at least one slot 14 for inserting material (such as data bearing documents, bottles, or the like) to be shredded. The primary slot 14 guides material to be shredded to shredder blades 18 that are driven by a motor 24 located in the shredder head housing 12. The plurality of shredder blades 18 are disposed within the shredder head housing 12 and are adapted to shred material inserted into the slot 14.

The shredder head housing 12 preferably includes a housing section 40 that is moveable between first and second housing section positions. FIG. 1 illustrates the housing section 40 in the first housing section position and FIG. 2 illustrates the housing section 40 in the second housing section position. The housing section 40 may define the slot 14 and can include an enclosure 44 that is adapted for vertical movement relative to the remainder 42 of the shredder head housing 12.

Figure 3:
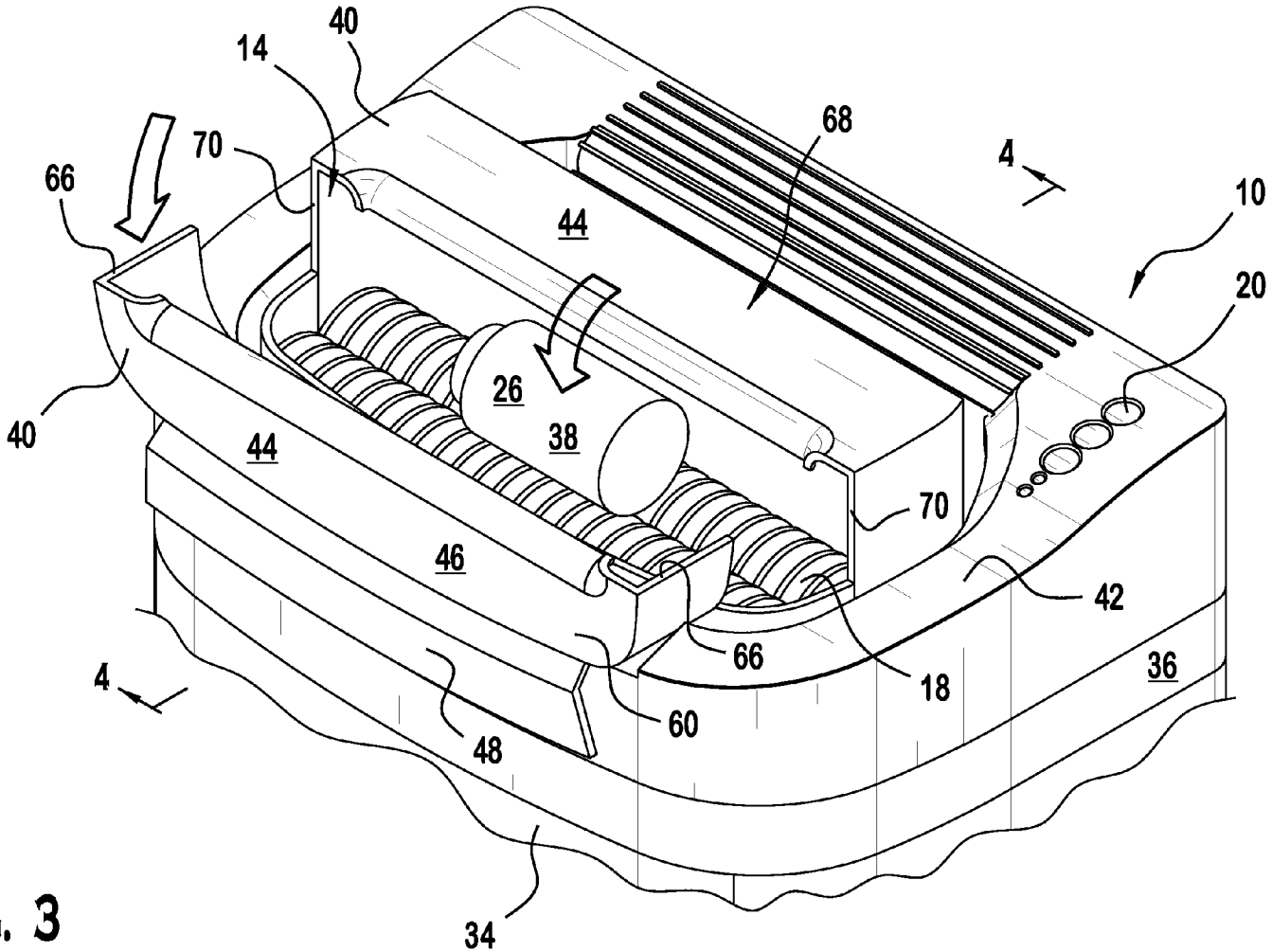
FIG. 3 is a partial enlarged view of the shredder of FIG. 1 illustrating the housing section in the second housing section position; The enclosure includes an enclosure panel that is moveable between first and second enclosure panel positions; The housing section is in the second housing section position and the enclosure panel is in the second enclosure panel position such that the shredder head is configured to receive a bottle for shredding.

Referring to FIGS. 2 and 3, the enclosure 44 preferably includes an enclosure panel 46 that defines at least a portion of the slot 14 and is moveable between first and second enclosure panel positions. When the enclosure panel 46 is in the first enclosure panel position (shown in FIG. 2) the housing section 40 is configured such that the slot 14 is oriented in a first slot configuration and the slot 14 is adapted to receive data bearing documents. When the enclosure panel 46 is in the second enclosure panel position (shown in FIG. 3) the housing section 40 is configured such that the slot 14 is oriented in the second slot configuration and the slot 14 is adapted to receive bottles. While one preferred construction of the housing section 40 and various slot configurations have been described, those of ordinary skill in the art will appreciate from this disclosure that any method of modifying the shredder head housing 12 to accommodate bottles and any method of adjusting the slot configuration to accommodate bottles 38 may be used without departing from the scope of the present invention.

Figure 5:
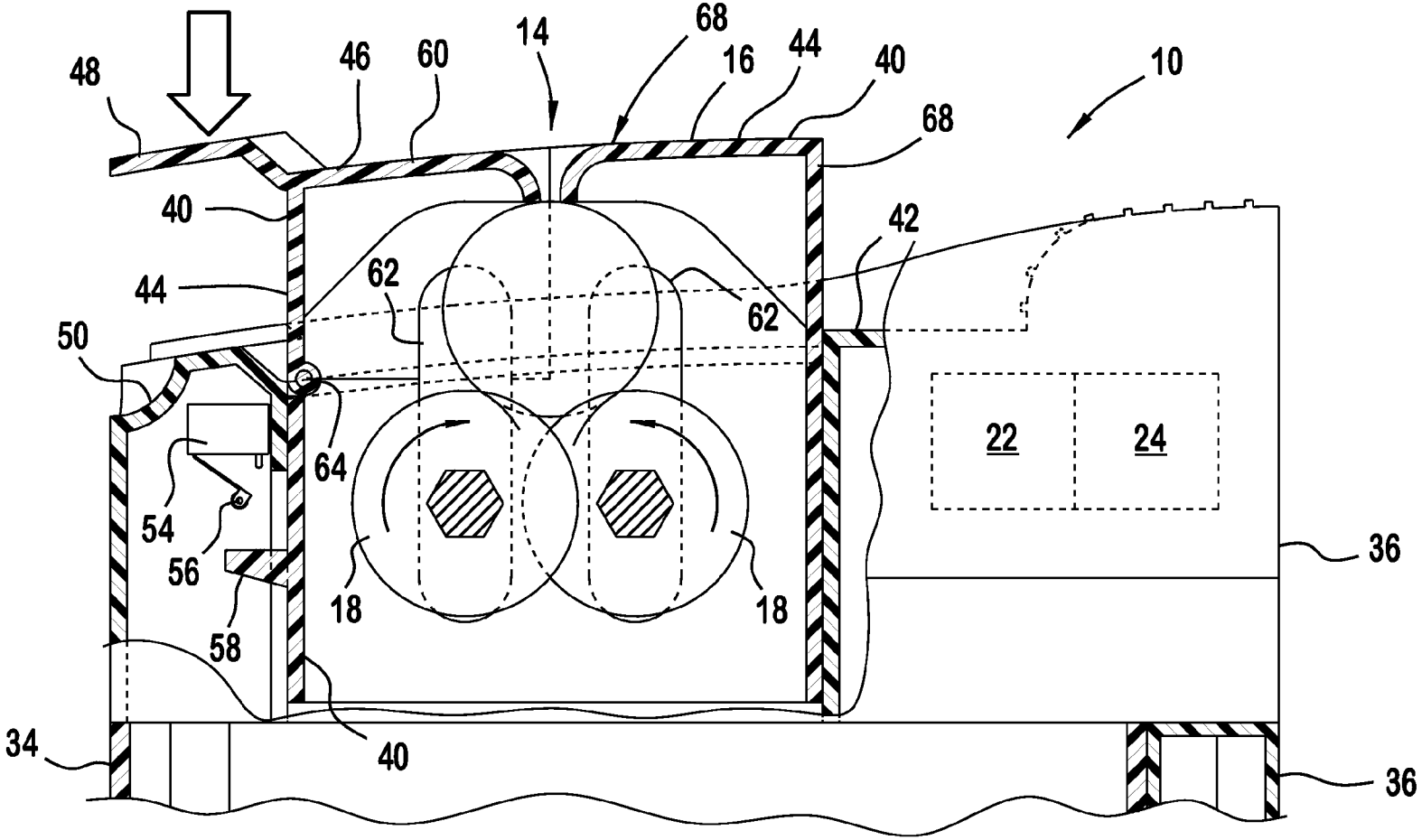
FIG. 5 is a cross-sectional view of the shredder of FIG. 2 as taken along the line 5-5 in FIG. 2 illustrating the volume that may be defined by the housing section when the housing section is in the second housing section position; The volume is preferably adapted to contain a bottle to be shredded; Once a bottle is position in the volume, it is preferred that the enclosure panel is returned to the first enclosure panel position and that the flange is used to push the housing section generally downwardly to facilitate shredding the bottle.

As best shown in FIGS. 2 and 5, a flange 48 may be located on the enclosure panel 46 and extend therefrom. The flange 48 can be configured to facilitate rotation of the enclosure panel 46 and to facilitate the application of force onto the enclosure 44 in a general direction of the remainder 42 of the shredder head housing 12. A groove is preferably located on the top 16 of the shredder head housing 12 below the flange 48 to make it easy to grasp the flange 48 when the housing section 40 is in the first housing section position. As shown in FIG. 5, the enclosure 44 is preferably configured to facilitate the pushing of the bottle 38 (or other material 26) past the plurality of shredder blades 18 after the bottle 38 is inserted into the enclosure 44 and the enclosure panel 46 is moved into the first enclosure panel position.

When the housing section 40 is in the first housing section position (shown in FIG. 1), the shredder head 10 is adapted to receive data bearing documents to be shredded. When the housing section 40 is in the second housing section position (shown in FIGS. 2 and 5) a volume is defined within the housing section 40 that is adapted to contain the bottle 38 for shredding.

Figure 4:
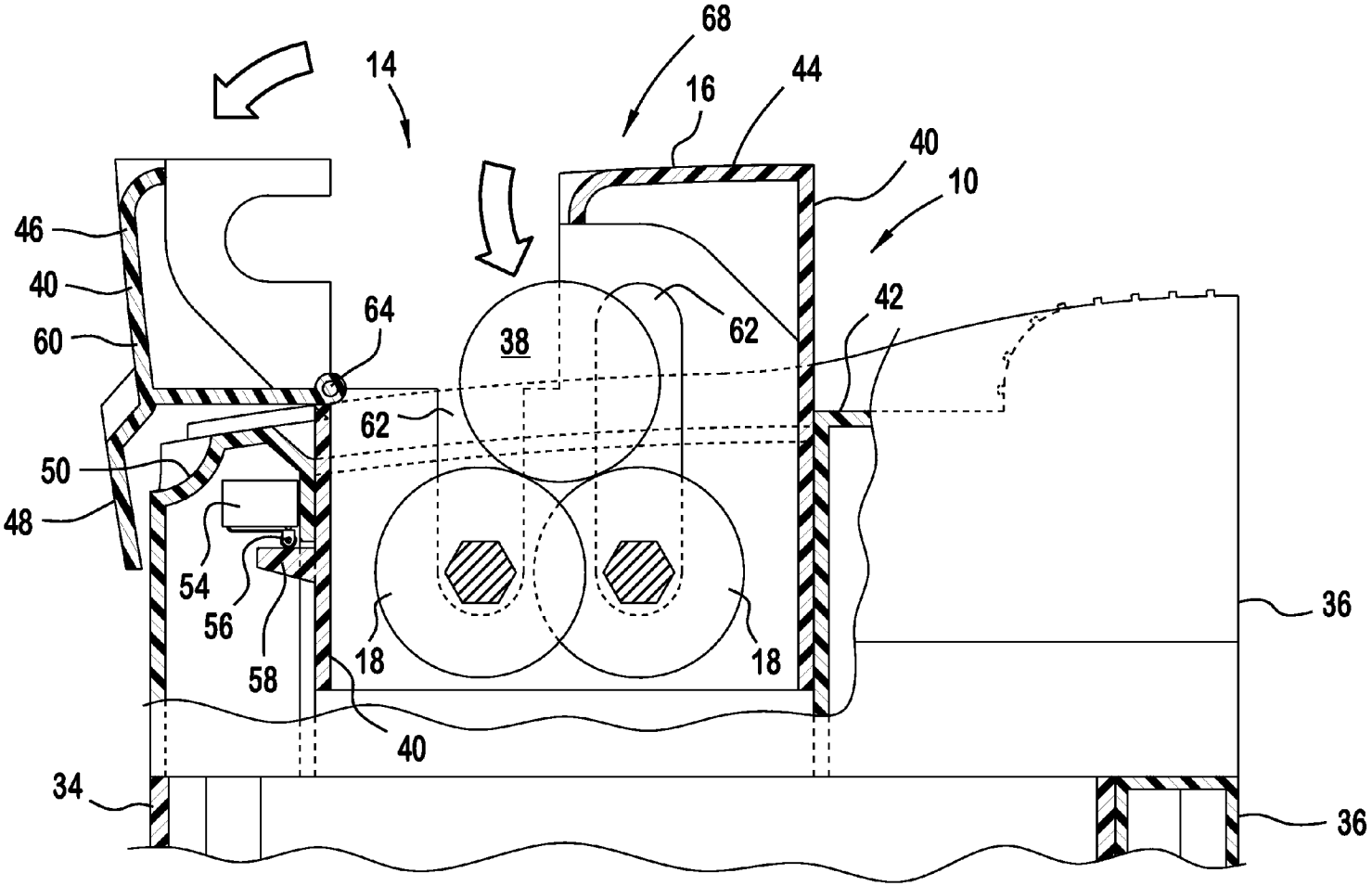
FIG. 4 is a cross-sectional view of the shredder of FIG. 3 as taken along the line 4-4 in FIG. 3; Guides slots are present in the enclosure to allow the enclosure to at least partially cover the shredder blades and to allow the enclosure to slide thereover; A flange is attached to the enclosure panel to facilitate rotation of the enclosure panel and to facilitate the application of force onto the enclosure in a general direction of the remainder of the shredder head housing; It is preferred that the lower left side of the enclosure include an abutment positioned thereon and projecting generally outwardly therefrom; The shredder head may include a sensor and a prong; The abutment may depress the prong to activate the sensor when the housing section is in the second housing position.

Referring to FIG. 1, the shredder head housing 12 defines a slot 14. The shredder head housing 12 is preferably configurable to orient the slot 14 in first and second slot configurations (as shown in FIGS. 1 and 4, respectively). Those of ordinary skill in the art will appreciate from this disclosure that any other suitable slot configurations can be used without departing from the scope of the present invention. When the shredder head housing 12 is configured so that the slot 14 is in the first slot configuration, the shredder head is adapted to receive data bearing documents. When the shredder head housing 12 is configured so that the slot 14 is in the second slot configuration, the shredder head 10 is adapted to receive bottles 38 for shredding. While the preferred embodiment of the shredder head 12 incorporates a vertically adjustable housing section, those of ordinary skill in the art will appreciate from this disclosure that any other shredder head design that allows for the insertion of bottles can be used without departing from the scope of the present invention.

Referring to FIGS. 4 and 5, the housing section 40 preferably includes an abutment 58 positioned thereon and projecting generally outwardly therefrom. The shredder head 10 can also include a sensor 54 and a contact prong 56. It is preferred that the abutment 58 is configured to depress the contact prong 56 and activate the sensor 54 when the housing section 40 is in the second housing section position. The sensor is preferably in communication with a controller 22 that causes a motor 24 to deactivate the shredder blades 18 when the sensor 54 is activated. The shredder blades 18 are disposed within the shredder head housing 12 and are adapted to shred material inserted therein.

Referring to FIG. 4, the enclosure 44 preferably includes at least one guide slot 62 therethrough to allow the enclosure 44 to at least partially cover the plurality of shredder blades 18 and to slide thereover. It is preferred that four slots 62 are located in the enclosure 44 so that the drive shafts for the shredder blades 18 can be maintained in position while the housing section 40 is vertically adjusted.

The shredder 10 may include a controller 22 that is in communication with a motor 46 in the shredder and various sensors and controls. The controller 22 is preferably in communication with the shredder head 10 and prevents operation of the shredder blades 18 once the housing section 40 moved from the first housing section position until the enclosure panel 46 has been moved out of the first enclosure panel position and then returned to the first enclosure panel position. Similarly, the controller 22 may prevent operation of the shredder blades 18 while the enclosure panel 46 is in the second enclosure panel position or the controller 22 may prevent the operation of the shredder blades 18 when the shredder head 12 is configured so that the slot 14 is oriented in the second slot configuration.

As best shown in FIGS. 1 and 5, the shredder head 10 may be used with a shredder basket 34 that has a housing 36 and an opening located proximate the shredder head housing 12 and is adapted to receive the material 26 shredded by the plurality of shredder blades 18. However, those of ordinary skill in the art will appreciate from this disclosure that the shredder head 10 can be used with any type of receptacle or shredder basket without departing from the scope of the present invention.

Referring to FIG. 1, the shredder 10 preferably includes a selectable control 28, such as a biometric switch, that is in communication with the shredder 10 and prevents movement of the housing section 40 from the first housing section position until the selectable control is activated. Similarly, the control 18, may prevent the shredder housing 12 from being configured such that the slot 14 is removed from the first slot configuration until the control is activated. One non limiting example of a suitable biometric sensor is the MBF Solid State Fingerprint Sensor manufactured by Fujitsu. Details regarding one possible construction of a fingerprint sensor is set forth in U.S. Pat. No. 7,235,853, entitled "Fingerprint Detection Device and Method of its Manufacture, and Apparatus for Forming a Protective Film", which issued on Jun. 26, 2007, and which is hereby incorporated by reference in its entirety as if fully set forth herein. While two examples of biometric sensors have been mentioned, those of ordinary skill in the art will appreciate that any suitable biometric sensor 28 can be used with the shredder 10 of the present invention without departing from the scope of the present invention. For example, the biometric sensor 28 can be configured for fingerprint recognition, palm recognition, voice recognition, facial recognition, retinal scanning, temperature recognition, or for detection of any suitable biometric parameter. The biometric sensor 28 is in communication with the shredder 10 and is adapted to detect predetermined biometric information. The biometric sensor can be configured to accept predetermined biometric information that includes multiple users or a single user without departing from the scope of the present invention.

The present invention also includes multiple methods of shredding material. One preferred method of the present invention will be described in conjunction with various preferred embodiments of the shredder 10. The steps of the method of the present invention can be performed in any order, omitted, or combined without departing from the scope of the present invention. As such, optional steps described in conjunction with one method can also be used or omitted. Additionally, unless otherwise stated, similar components described in conjunction with the method preferably, but not necessarily, operate in a generally similar manner to that described elsewhere in this application.

The first preferred method of shredding material, includes: providing a shredder that defines at least one slot 14 for receiving material. The shredder includes a plurality of shredder blades 18 adapted to shred material 26, 38 inserted into the at least one slot 14. The shredder is configurable to shred data bearing documents and bottles 38. While a preferred shredder configuration has been described above, those of ordinary skill in the art will appreciate that any shredder configuration that allows for the shredding of both data bearing documents and bottles (preferably prescription bottles 38) can be used without departing from the scope of the present invention. The method may include adjusting the volume enclosed by the shredder head housing 12 to allow for the placement of a bottle 38 therein. Enlarging the slot 14 to allow the insertion of a bottle 38 into the shredder head 10 may also form part of the method. The activation of the shredder blades 18 may prevented while a bottle 38 is being inserted through the slot 14.

The method may include adjusting at least a portion of the shredder head housing 12 to form an enclosure 44 for receiving a bottle 38 for shredding. The insertion of a bottle 38 into the shredder may be prevented until a selectable control is activated (which may be a biometric control). The detection of biometric data by the shredder head 10 may be required prior to allowing the insertion of a bottle 38 therein.

One preferred embodiment of the present invention operates as follows. Referring to FIG. 1, a user may activate the selectable/biometric control 28 to allow the housing section 40 to be moved out of the first housing section position. Then a user inserts a portion of his or her hand into the groove 50 beneath flange 48 and lifts the housing section generally upwardly. Referring to FIGS. 2 and 3, once the housing section 40 is in the second housing section position, the flange 48 is used to rotate the enclosure panel 46 about hinge 64 to orient the slot 14 to receive a bottle 38 therethrough. Referring to FIGS. 3 and 4, once the bottle is inserted into the enclosure 44, the enclosure panel is rotated into the first enclosure panel position (as shown in FIG. 5) to contain the bottle 38 in a volume defined by the enclosure 44. Then, the flange 48 can be depressed to press the bottle 38 against the shredder blades 18 for shredding. While the movement of the housing section 40, enclosure 44, and enclosure panel 46 has been described as manually driven, those of ordinary skill in the art will appreciate from this disclosure that such movements can be automated without departing from the scope of the present invention.

Referring to FIGS. 6-22, briefly speaking, the shredder/shredder head 10 includes a shredder head 10 and a shredder basket 34. The shredder head 10 includes a shredder head housing 12 which is configured to receive data bearing documents to be shredded and is configured to receive a bottle for shredding. A plurality of shredder blades 18 are disposed within the shredder head housing 12 and are adapted to shred data bearing documents and/or bottles inserted therein. The shredder head housing 12 defines a shredder cavity 136 and a shredder cavity opening 138. The shredder head 10 further includes a shredder cavity door 76 which covers the opening to the shredder cavity 138. When the shredder cavity door 76 is in its fully open position (shown in FIG. 6), the shredder cavity opening 138 can receive a bottle 38 for placement in the shredder cavity 136. When the shredder cavity door 76 is moved into its fully closed position (shown in FIG. 7), the bottle 38 located in the shredder cavity 136 is preferably shredded by the action of the plurality of shredder blades 18.

Referring to FIG. 6, one preferred embodiment of the shredder head 10 of the present invention includes a shredder cavity door 76. The shredder cavity door 76 may define a slot 14 for inserting material (such as data bearing documents, bottles, or the like) to be shredded. The primary slot 14 guides material to be shredded to the plurality of shredder blades 18 that are disposed within the shredder head housing 12. The plurality of shredder blades 18 are adapted to shred material inserted into the slot 14.

While the preferred shredder head 10 includes a shredder cavity door 76 which defines a slot 14 for inserting material to be shredded, those of ordinary skill in the art will appreciate from this disclosure that the shredder head housing 12 may define at least one slot for inserting material to be shredded without departing from the scope of the present invention, and the at least one slot may replace or supplement the slot 14 defined by the shredder cavity door 76 without departing from the scope of the present invention.

Figure 7:
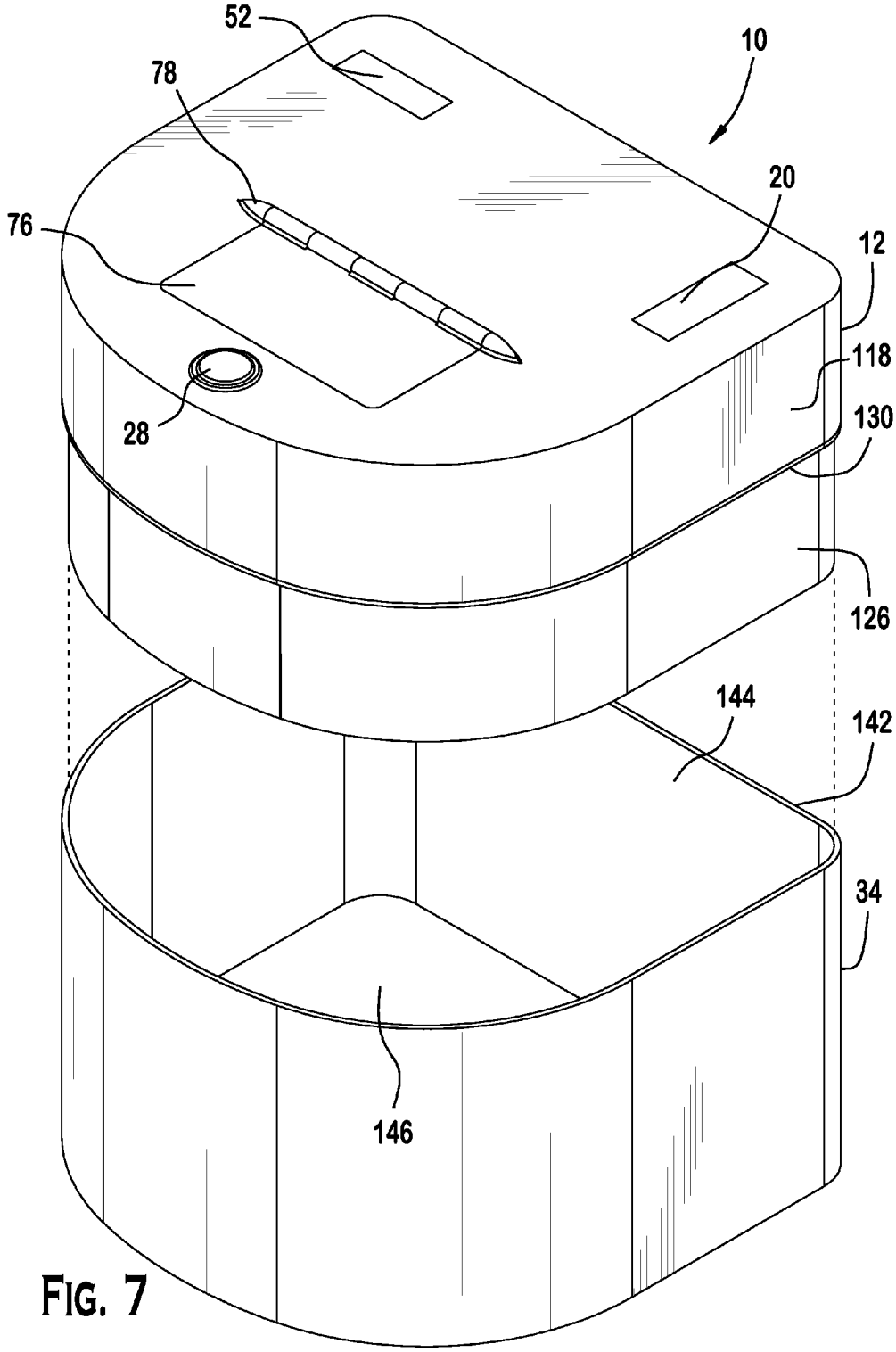
FIG. 7 is a perspective view of a shredder similar to that of FIG. 6, in which the shredder head is shown detached from the shredder basket and the shredder cavity door is shown in the fully closed position; The shredder cavity door does not include an additional slot in this figures.

Referring to FIGS. 6 and 7, the shredder head 10 includes a shredder cavity door 76 which may pivot about a hinge 78 between a fully open position (shown in FIG. 6) and a closed position (shown in FIG. 7). The shredder head 10 can include a sensor which detects when the shredder cavity door 76 is partially or fully in its open position. The sensor is preferably adapted to deactivate the plurality of shredder blades 18 when the shredder cavity door is at least partially open. The sensor may be in communication with a controller that is in communication with a motor 24 in the shredder head and may also be in communication with other various sensors and controls. The controller preferably prevents operation of the shredder blades 18 when the shredder cavity door 76 is at least partially open.

Referring to FIG. 6, the shredder head 10 preferably includes a selectable control 28 that is in communication with the shredder 10 and prevents movement of the shredder cavity door 76 from the closed position to the open position until the selectable control 28 is activated. The shredder head 10 preferably includes a switch 52 which allows the shredder head 10 to be placed into at least one activated mode. In one possible activated mode, the plurality of shredder blades 18 may be activated when the shredder cavity door 76 is in its fully closed position, and deactivated when the selectable control 28 is activated and the shredder cavity door 76 can be moved to the open position.

Referring to FIGS. 6 and 7, the shredder head 10 may be used with a shredder basket 34 that has an opening located proximate the shredder head housing 12 and is adapted to receive the material shredded by the plurality of shredder blades 18. When the shredder 10 is in its assembled configuration as shown in FIG. 6, the inner surface of the shredder basket 144 may contact the bottom casing 126 of the shredder head housing 12 and may entirely surround the basket volume. Material 26 shredded by the plurality of shredder blades 18 is deposited on the bottom surface of the shredder basket 146. However, those of ordinary skill in the art will appreciate from this disclosure that the shredder head 10 can be used with any type of receptacle or shredder basket without departing from the scope of the present invention.

Figure 8:
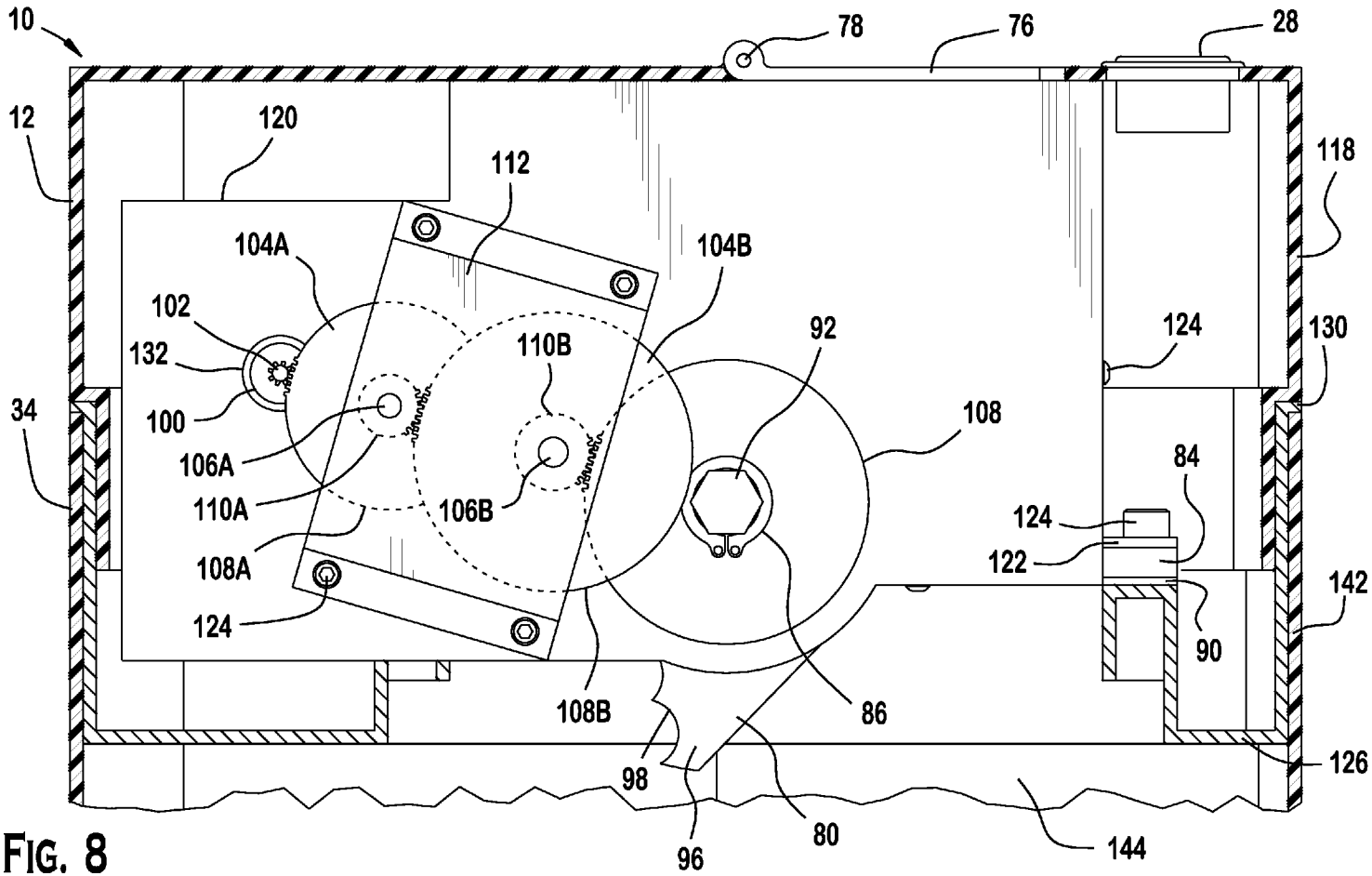
FIG. 8 is a side, elevational, broken away view of a part of the shredder of FIG. 6 in which the shredder head housing is shown to be comprised of a top casing, a bottom casing, a shredder head housing core, and a gear bracket; A part of the top casing of the shredder head housing, a part of the bottom casing of the shredder head housing, and a part of the shredder basket have been removed to illustrate the relative position of the components of the shredder head housing and other components of the shredder.

Referring to FIG. 8, the shredder head 10 is attached to the shredder basket 34. The shredder head 10 includes a shredder head housing 12. The shredder head housing 12 preferably, but not necessarily, includes a top casing 118, a bottom casing 126, a shredder head housing core 120, and a gear bracket 112. Parts of the top casing 118, the bottom casing 126, and the shredder basket 34 have been removed to illustrate the relative positions of the components of the shredder head housing 12 and some other components of the shredder head 10. The bottom casing 126, the shredder head housing core 120, and the gear bracket 112 may be attached by fasteners 124.

A motor flange 100 preferably extends through a motor flange hole 134 in the shredder head housing core, and from it extends a motor axle 102. The teeth of the motor axle 102 can intermesh with teeth of a driven gear 108A of a first reduction gear 104A, and rotation of the motor axle 102 causes an oppositely oriented rotation of the first reduction gear 104A about the first gear axle 106A. The first reduction gear comprises a driving gear 110A whose teeth can intermesh with the teeth of a driven gear 108B of a second reduction gear 104B, and rotation of the first reduction gear 104A causes an oppositely oriented rotation of the second reduction gear 104B about the second gear axle 106B. The second reduction gear comprises a driving gear 110B whose teeth intermesh with the teeth of a shredder blade axle gear 114, and rotation of the second reduction gear 104B causes an oppositely oriented rotation of the shredder blade axle gear 114 about the axis defined by a shredder blade axle 92. The shredder blade axle 92 is attached to the shredder blade axle gear 114 such that rotation of the shredder blade axle gear 114 causes rotation of the shredder blade axle 92. The ratios of gear diameters in the motor axle 102, first reduction gear 104A, second reduction gear 104B, and shredder blade axle gear 114 preferably cause the shredder blade axle 92 to rotate at a much slower rate than the motor axle 102 with sufficient torque to enable the plurality of shredder blades 18 to shred data bearing documents and bottles inserted into the shredder head housing 12. Each of the gear axles 106A, 106B has two attachment points to the shredder head housing 12, first at the shredder head housing core 120 and second at the gear bracket 112. The gear bracket 112 is attached to the shredder head housing core by four fasteners 124.

Figure 9:
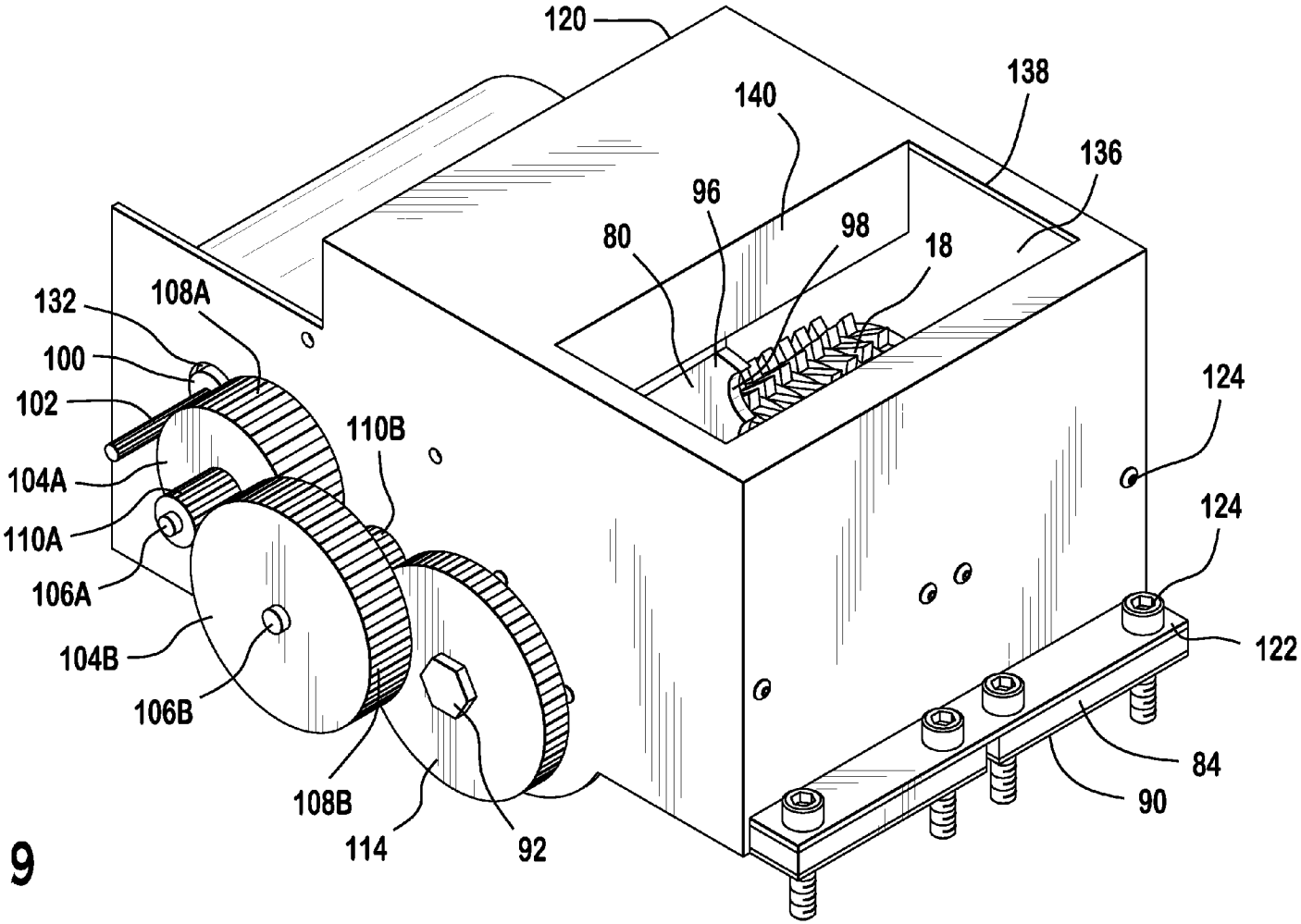
FIG. 9 is a perspective view of the shredder head housing core and components of the shredder head which are attached to the shredder head housing core or disposed within the shredder head housing core (hereinafter referred to as the shredder head assembly in the brief description of the drawings) in the shredder of FIG. 6; A motor axle drives the first of a series of reduction gears, the last of which drives an axle gear which turns a shredder blade axle; The plurality of shredder blades are located along the shredder blade axle and extend into the shredder cavity.

Referring to FIG. 9, the shredder head housing core 120 together with the components of the shredder head 10 disposed within the shredder head housing core 120, the motor axle 102, the reduction gears 104A, 104B, the gear axles 106A, 106B, and the shredder blade axle gear 114 form an assembly (hereinafter also referred to as the shredder head assembly 172 in the detailed description of the preferred embodiments). The shredder head assembly 172 defines the periphery of the shredder cavity 136 and the perimeter of the shredder cavity opening 138. The plurality of shredder blades 18 preferably extend into the shredder cavity 136. The shredder head housing core 120 includes a flange 140 proximate to the shredder cavity opening 138 which guides a bottle to be shredded toward the plurality of shredder blades 18.

Figure 10:
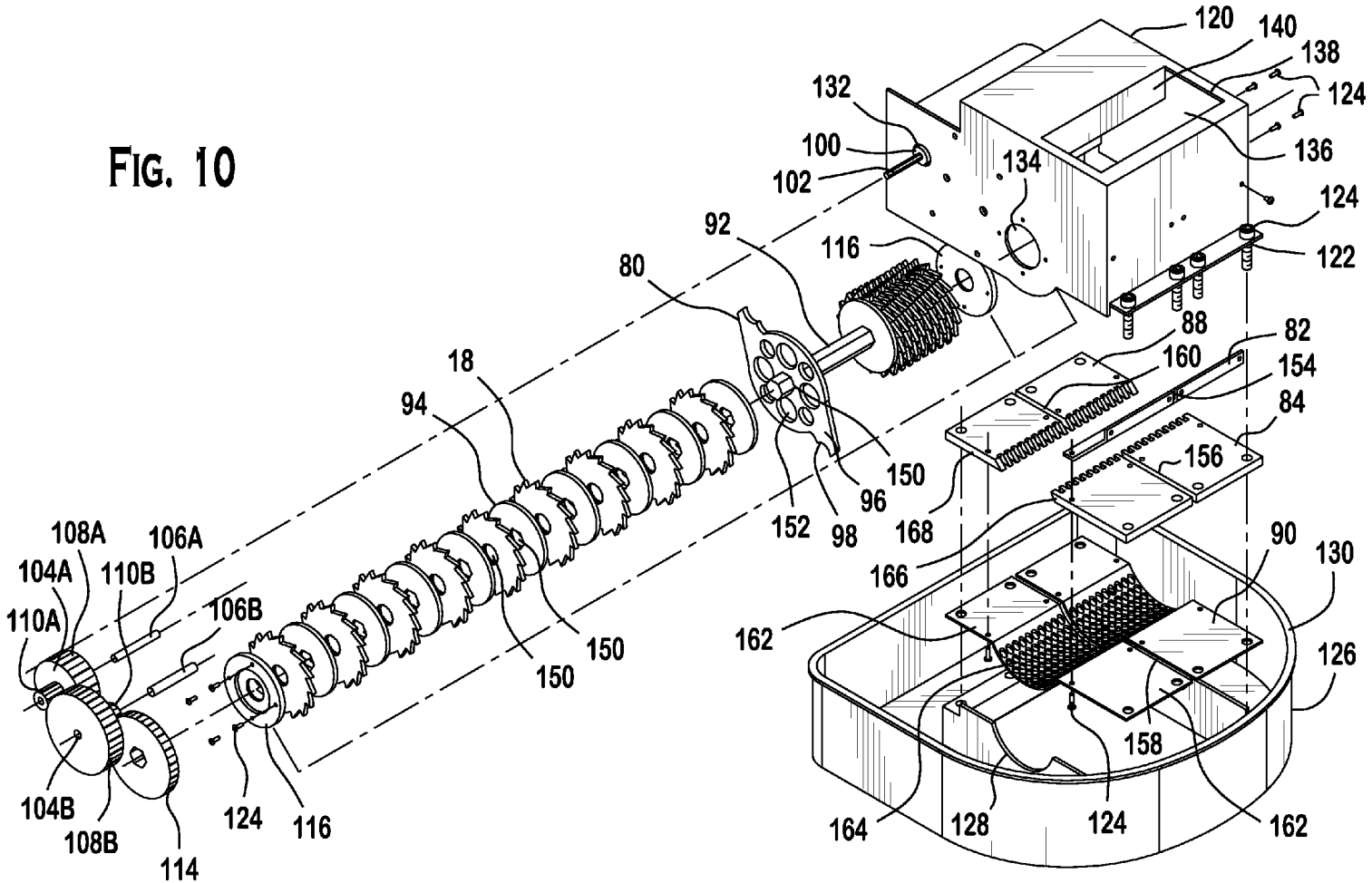
FIG. 10 is a perspective, exploded view of the shredder head assembly of FIG. 6; The plurality of shredder blades are interspersed with spacers and include a majority of shredder blades of similar radius and one major blade; The major blade may include two shafts which extend past the maximum radius of each shredder blade of the majority of shredder blades; The shredder head may include two guide plates, two brace plates, two grates, and two stripper plates, each attached to the shredder head housing core; Each of the two grates comprises a mounting section and a sorting section; The shredder head housing core is attached to the bottom casing of the shredder head housing.

Referring to FIG. 10, the shredder head 10 is preferably, but not necessarily, configured to shred bottles using the plurality of shredder blades 18 and only the single shredder blade axle 92, and all of the plurality of shredder blades 18 disposed within the shredder blade housing 12 rotate about a single axis defined by the shredder blade axle 92. The shredder head housing core 120 defines the shredder blade axle hole 134, and the shredder blade axle 92 extends therethrough. The plurality of shredder blades 18 may be interspersed with a plurality of spacers 94 such that any two shredder blades 18 are separated by at least one spacer 94. The plurality of shredder blades 18 includes a majority of shredder blades 18 of a generally similar radius, and includes one major blade 80. The major blade 80 may include at least one shaft, but preferably two or more shafts, 96 which extend radially outwardly for a distance greater than the maximum radius of any of the majority of shredder blades 18. The major blade 80 may define a plurality of bores 152 therethrough which reduce the mass of the major blade 80 without reducing the strength of the major blade 80. Two shredder blade axle plates 116 can separate the plurality of shredder blades 18 from the shredder head housing core 120, and are attached to the shredder head housing core by fasteners 124.

The shredder head assembly 172 may include two guide plates 82 which are oriented in an askew position relative to a plane generally defined by the bottom side of the shredder head housing 12, hereinafter referred to as the base plane in the detailed description of the preferred embodiments. The two guide plates 82 are preferably separated by a guide plate gap 154. However, those of ordinary skill in the art will appreciate from this disclosure that any number of guide plates 82 may be incorporated or that guide plates 82 may be omitted altogether without departing from the scope of the present invention.

The shredder head assembly 172 may further include two brace plates 84 which are preferably, but not necessarily, oriented parallel to the base plane. Each of the two brace plates 84 can be adjacent to one of the two guide plates 82. The two brace plates 84 are preferably separated by a brace plate gap 156. The two brace plates 84 may include a plurality of brace teeth 166. However, those of ordinary skill in the art will appreciate from this disclosure that any number of brace plates 84 may be incorporated or that brace plates 84 may be omitted altogether without departing from the scope of the present invention.

The shredder head assembly 172 can further include two stripper plates 88 which are preferably, but not necessarily, oriented parallel to the base plane. The two stripper plates 88 are preferably separated by a stripper plate gap 160 through which the two shafts 96 of the major blade 80 pass during rotation. The two stripper plates 88 can include a plurality of stripper teeth 167. However, those of ordinary skill in the art will appreciate from this disclosure that any number of stripper plates 88 may be incorporated or that stripper plates 88 may be omitted altogether without departing from the scope of the present invention.

The shredder head assembly 172 may further include two grates 90, each of which preferably includes two mounting sections 162 and a sorting section 164. Each grate may contact the bottom casing 126 of the shredder head housing 12 along the grate attachment surface 128. The mounting section 162 of each grate 90 is preferably, but not necessarily, oriented parallel to the base plane. On each grate 90, one of the two mounting sections 162, hereinafter referred to as the first mounting section, might be connected to one of the two brace plates 84 and one of the two guide plates 82 by two fasteners 124. The other of the two mounting sections 162, hereinafter referred to as the second mounting section, is preferably, but not necessarily, connected to one of the two stripper plates 88 by two fasteners. The two grates 80 may be separated by a grate gap 162. The sorting section 164 of each grate 90 can define a plurality of holes therethrough, and the sorting section 164 preferably forms a plurality of sharpened edges at the perimeter of each hole in the plurality of holes.

Figure 11:
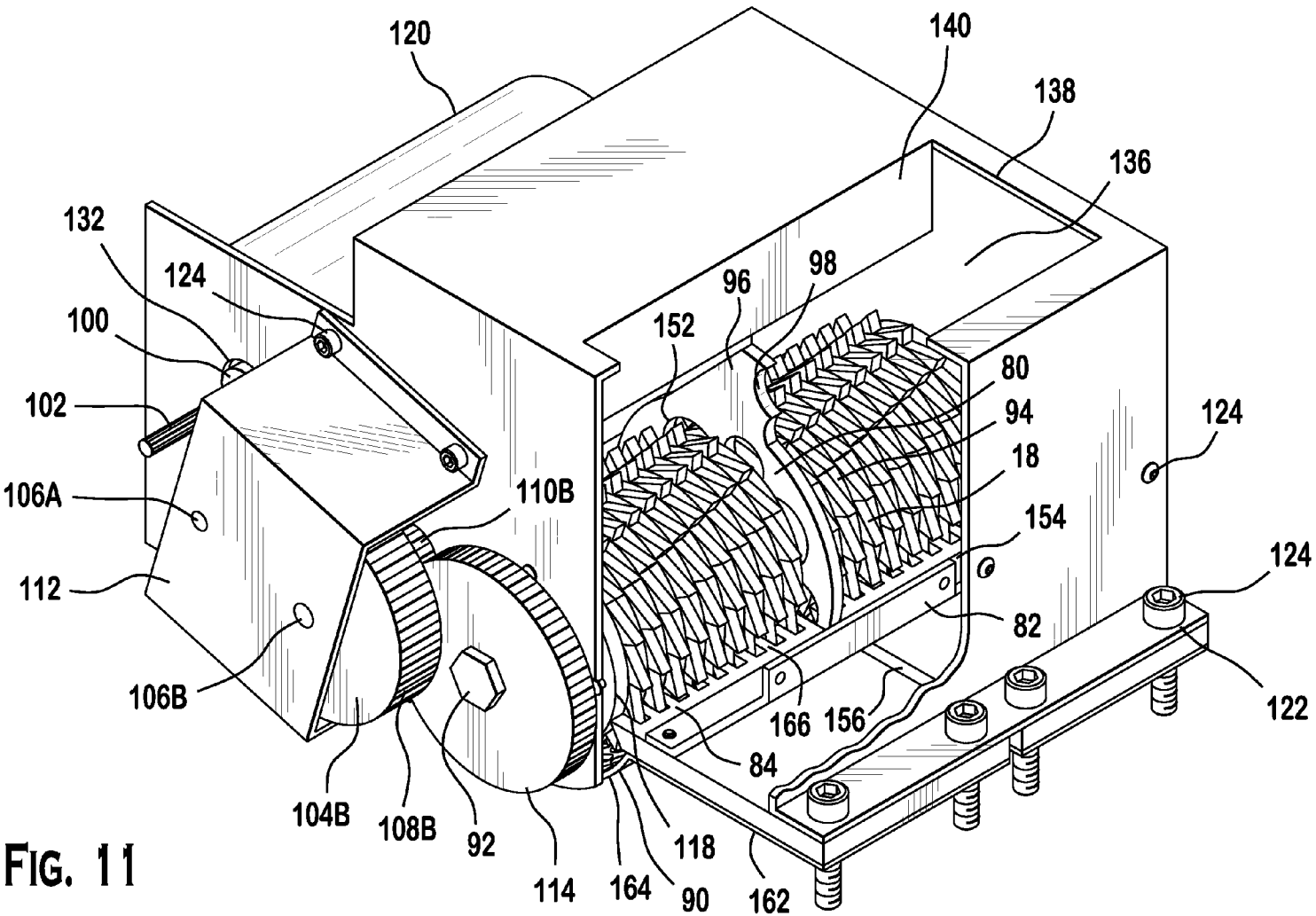
FIG. 11 is a perspective, broken away view of the shredder head assembly and the gear bracket in the shredder of FIG. 6; A part of the shredder head housing core has been removed to illustrate the position of the plurality of shredder blades, guide plates, and brace plates within the shredder cavity.

Referring to FIG. 11, the plurality of brace teeth 166 of the brace plate 84 are preferably interspersed with the plurality of shredder blades 18 and allow passage therebetween of the plurality of shredder blades 18 during rotation. During rotation of the major blade, the two shafts 96 of the major blade 80 may pass through the brace plate gap 156 which separates the two brace plates 84. A contact surface 98 is preferably located on each of the two shafts 96 of the major blade 80, and the contact surface 98 is the first surface of the shaft 96 to pass through the brace plate gap 156.

Referring to FIG. 12, all of the plurality of shredder blades 18 disposed within the shredder head housing 12 may be configured to rotate about the single axis defined by the shredder blade axle 92. The rotation of the major blade 80 can carry the shaft 96 of the major blade 80 through the guide plate gap 154, the brace plate gap 156, and the stripper plate gap 160. Each of the majority of the plurality of shredder blades 18 is preferably rotationally offset from the closest shredder blade 18 on either side. The distal end of each guide plate 82 is located generally adjacent to the plurality of shredder blades 18. The distal end of each guide plate 82 is attached to one of the two brace plates 84 and one of the two grates 90 by fasteners 124.

Referring to FIG. 13, during rotation of the major blade, the two shafts 96 of the major blade 80 may be able to pass through the guide plate gap 154 which can separate the two guide plates 82. The shredder blade axle gear shaft 174 of the shredder blade axle gear 14. The plurality of stripper teeth 168 of the stripper plate 88 may be interspersed with the plurality of shredder blades 18 and allow passage therebetween of the plurality of shredder blades 18 during rotation. The two shafts 96 of the major blade 80 preferably pass through the stripper plate gap 160 which separates the two stripper plates 88. The shredder blade axle gear shaft 174 of the shredder blade axle gear 114 extends to the shredder blade axle plate 116.

Referring to FIG. 14, during rotation of the major blade, the two shafts 96 of the major blade 80 may pass through the grate gap 158 which separates the two grates 82. The sorting section 164 of each of the two grates 82 is preferably located in close proximity to the outward radial edges of the plurality of shredder blades 18.

Referring to FIG. 15, one of the two guide plates 82 is shown in profile, and both guide plates are similarly oriented within the shredder cavity 136. The two guide plates 82 are preferably oriented at an angle between approximately about ten (10) degrees and approximately about eighty (80) degrees from the base plane. The two guide plates 82 are more preferably oriented at an angle between approximately about thirty (30) degrees and approximately about sixty (60) degrees from the base plane. The two guide plates 82 are more preferably still oriented at an angle of approximately about forty-five (45) degrees from the base plane. The two guide plates 82 are preferably adapted to guide a bottle 38 toward the plurality of shredder blades 18.

The distal end of each guide plate 82 may be located generally adjacent to the plurality of shredder blades 18. The distal end of each guide plate 82 may be attached to one of the two brace plates 84 and one of the two grates 90 by fasteners 124. The flange 140 of the shredder head housing core 120 can, but does not necessarily, prevent a bottle 38 inserted into the shredder head 10 from traveling along a path which does not carry it to an interface between the plurality of shredder blades 18 and the two brace plates 84.

One of the two brace plates 84 is shown in profile, as is one of the two stripper plates 88. The mounting section of one of the two grates 90 is also shown in profile. A fastener 124 may connect the shredder head housing attachment 122 of the shredder head housing core 120, the brace plate 84, the first mounting section of the grate 90, and the bottom casing 126 of the shredder head housing 12. Another fastener 124 can connect the shredder head housing attachment 122 of the shredder head housing core 120, the stripper plate 84, the second mounting section of the grate 90, and the bottom casing 126 of the shredder head housing 12. The bottom casing 126 of the shredder head housing 12 may include a shoulder 130 which contacts the top surface 142 of the shredder basket. The shredder head housing core 120 preferably includes a flange 140 which prevents a bottle inserted into the shredder head 10 from following a path which does not bring the bottle towards the interface between the plurality of shredder blades 18 and the brace plate 84.

Referring to FIG. 16, the rotation of the plurality of shredder blades 18 about the axis of the shredder blade axle 92 preferably brings the contact surface 98 of the shaft 96 of the major blade 80 into contact with the bottle 38. The rotation of the plurality of shredder blades 18 preferably, but not necessarily, deforms, pierces, cuts, slices, pulls, pushes and/or engages the bottle 38 and drags the bottle 38 towards the interface between the plurality of shredder blades 18 and the brace plate 84.

Referring to FIG. 17, the interaction of the plurality of shredder blades 18 and the brace teeth 166 of the brace plate 84 cuts the bottle 38 into partially shredded pieces 176. The movement of the plurality of shredder blades 18 may carry the partially shredded pieces 176 towards the sorting section 164 of one of the two grates 90. The sorting section 164 is preferably configured to prevent the partially shredded pieces 176 above a predetermined size from passing through the sorting section 164. Shredded material 148 passes through the sorting section 164 to be deposited in the shredder basket 34. The movement of the plurality of shredder blades 18 further shreds the partially shredded pieces 176 which have not passed through the sorting section 164. The sorting section 164 facilitates cutting of the partially shredded pieces 176 by bracing the partially shredded pieces 176 against the at least some sharpened edges at the perimeter of at least one of the plurality of holes in the sorting section 164. Each of the two stripper plates 88 may remove partially shredded pieces 176 from the plurality of shredder blades 18 and prevents the partially shredded pieces 176 from being carried past the lower half of the rotational path of the plurality of shredder blades 18.

Referring to FIGS. 18 and 19, each of the plurality of shredder blades 18 defines a shredder blade axle bore 150 for passage therethrough of the shredder blade axle 92. The shape of the shredder blade axle bore 150 allows each of the majority of the plurality of shredder blades 18 to be rotationally offset from the closest shredder blade 18 on either side. Each of the plurality of spacers 94 defines a shredder blade axle bore 150 for passage therethrough of the shredder blade axle 92. However, those of ordinary skill in the art will appreciate from this disclosure that the shredder blades 18 and/or the spacers 94 may have any shape or configuration without departing from the scope of the present invention.

Referring to FIGS. 19 and 20, the major blade 80 preferably defines a shredder blade axle bore 150 for passage therethrough of the shredder blade axle 92. The major blade 80 may be of constant thickness, and may define the plurality of bores 152 to reduce the weight of the major blade 80. The shaft 96 preferably defines the contact surface 98 whose shape facilitates deforming the bottle 38 and dragging the bottle 38 along a path which brings it to the interface between the plurality of shredder blades 18 and the brace plate 84.

Referring to FIG. 22, the grate 90 preferably includes the sorting section 164 and the two mounting sections 166. Each of the two mounting sections 166 preferably defines four bores for passage of a fastener 124. The sorting section 164 may define the plurality of holes therethrough, and the sorting section 164 preferably forms a plurality of sharpened edges at the perimeter of at least some of the plurality of holes.

The present invention further includes additional methods of shredding material. The additional preferred methods of the present invention will be described in conjunction with various preferred embodiments of the shredder head 10. The steps of any of the following or preceding methods of the present invention can be performed in any order, omitted, or combined without departing from the scope of the present invention. As such, optional steps described in conjunction with one method can also be used or omitted. Additionally, unless otherwise stated, similar components described in conjunction with the method preferably, but not necessarily, operate in a generally similar manner to that described elsewhere in this application.

One preferred method of shredding material, includes: providing a shredder head housing 12 that is configured to receive data bearing documents to be shredded and is configured to receive a bottle 38 for shredding, providing a plurality of shredder blades 18 disposed within the shredder head housing and adapted to shred data bearing documents and bottles inserted therein, and engaging the bottle 38 received by the shredder head housing 12 prior to the commencement of cutting by at least some of the plurality of shredder blades 18 to at least one of cut, deform, and drag the bottle 38 toward at least some of the plurality of shredder blades 18 for shredding of the bottle 38. While a preferred shredder configuration has been described above, those of ordinary skill in the art will appreciate that any shredder configuration that allows for the shredding of both data bearing documents and bottles (preferably prescription bottles) can be used without departing from the scope of the present invention.

The method may include: guiding the bottle 38 which has been inserted into the shredder head housing 12 along a path askew to the base plane towards the plurality of shredder blades 18, bracing the bottle 38 during shredding, and exerting force on the bottle to maintain the bottle 38 in contact with at least some of the plurality of shredder blades 18. The method may further include the plurality of shredder blades 18 rotating about a single axis, and guiding the bottle 38 towards an interface between at least some of the plurality of shredder blades 18 and a stationary brace plate 84. The method may include separating partially shredded pieces of the bottle 176 above a predetermined size from the remaining shredded material 148 for further shredding. The method may include further shredding the partially shredded pieces of the bottle 176 until they are smaller than a predetermined size. The method may include removing shredded material from at least some of the plurality of shredder blades 18 prior to the shredded material being carried past the lower half of the rotation of the shredder blades 18.

Another preferred method of shredding material, includes: providing a shredder head housing 12 that is configured to receive a bottle 38 for shredding, providing a plurality of shredder blades 18 disposed within the shredder head housing and adapted to shred data bearing documents and bottles inserted therein, engaging the bottle 38 received by the shredder head housing 12 prior to the commencement of cutting by at least some of the plurality of shredder blades 18 to at least one of cut, deform, and drag the bottle 38 toward at least some of the plurality of shredder blades 18 for shredding of the bottle 38, and exerting force on the bottle to maintain the bottle 38 in contact with at least some of the plurality of shredder blades 18. While a preferred shredder configuration has been described above, those of ordinary skill in the art will appreciate that any shredder configuration that allows for the shredding of bottles (preferably prescription bottles) can be used without departing from the scope of the present invention.

The method may include the plurality of shredder blades 18 rotating about a single axis, and guiding the bottle 38 which has been inserted into the shredder head housing 12 along a path askew to the base plane towards an interface between at least some of the plurality of shredder blades 18 and a stationary brace plate 84. The method may include exerting force on partially shredded pieces of the bottle 176 to maintain the partially shredded pieces 176 in contact with at least some of the plurality of shredder blades 18 until the partially shredded pieces are below a predetermined size. The method may include removing shredded material from at least some of the plurality of shredder blades 18 prior to the shredded material being carried past the lower half of the rotation of the shredder blades 18.

One preferred embodiment of the present invention operates as follows. Referring to FIGS. 6 and 7, a user may activate the sensor 28 to allow the shredder cavity door 76 to be moved from the closed position to the fully open position. Once the shredder cavity door 76 is in the fully open position, a user inserts a bottle 38 through the shredder cavity opening 138 into the shredder cavity 136. The bottle 38 is guided along a path along the guide plates 82 along a plane askew to the base plane toward the plurality of shredder blades 18. When the shredder cavity door 76 is partially or fully in its open position, the plurality of shredder blades 18 are in a deactivated state. The user then closes the shredder cavity door 76. When the shredder cavity door 76 is fully in closed position, the plurality of shredder blades 18 are in an activated state. The plurality of shredder blades 18 includes the majority of shredder blades 18 with a generally similar radius and the one major blade 80, and all of the plurality of shredder blades 18 preferably rotate about a single axis defined by the shredder blade axle 92. The rotational motion of the major blade causes the contact surface 98 of the shaft 96 of the major blade 96 to engage the bottle 38, and the continued rotational motion of the major blade 80 deforms the bottle 38 and drags the bottle 38 toward the interface between the majority of shredder blades 18 and the two brace plates 84. The two brace plates 84 brace the bottle 38, and the rotational motion of the majority of shredder blades 18 cuts the bottle 38 into partially shredded pieces 176. The contact surface 98 of the shaft 96 of the major blade 96 continues to exert force on the bottle 38 to maintain the bottle 38 in contact with the majority of shredder blades 18 and facilitate further cutting of the bottle 38. The grate 90 separates the partially shredded pieces 176 which are above a predetermined size from those partially shredded pieces 176 of sufficiently small size, and the rotational motion of the majority of shredder blades 18 further shreds the partially shredded pieces 176 which are above the predetermined size until they are smaller than the predetermined size. The stripper plate 88 removes the partially shredded pieces 176 from the majority of shredder blades 18 prior to the majority of shredder blades 18 carrying the partially shredded material 176 past the lower half of the rotational path of the plurality of shredder blades 18. The partially shredded pieces 176 which are removed from the majority of shredder blades 18 continue to be shredded by the rotational motion of the majority of shredder blades 18 until they are smaller than the predetermined size. While the movement of the shredder cavity door 76 has been described as manually driven, those of ordinary skill in the art will appreciate from this disclosure that such movements can be automated without departing from the scope of the present invention.

It is recognized by those skilled in the art that changes may be made to the above described methods and/or shredder head 10 without departing from the broad inventive concept thereof. For example any other suitable shredder configuration that allows for the shredding of bottles can be used without departing from the scope of the present invention. It is understood, therefore, that this invention is not limited to the particular embodiments disclosed, but is intended cover all modifications which are within the spirit and scope of the invention as defined by the above specification, the appended claims and/or shown in the attached drawings.

What is claimed is:

1. A method of shredding bottles, comprising:

providing a shredder head housing configured to receive bottles for shredding;

providing a plurality of shredder blades disposed within the shredder head housing adapted to shred bottles inserted therein;

providing a major blade rotatably located about a common axis with at least some of the plurality of shredder blades, the major blade comprises at least one shaft which extends radially outwardly from the common axis for a distance greater than the maximum radius of any of the plurality of shredder blades; and engaging bottles via the major blade prior to the commencement of cutting by the plurality of shredder blades, the major blade at least one of cutting, deforming, and dragging bottles toward the plurality of shredder blades for shredding thereof.

2. The method of claim 1, further comprising:

guiding bottles inserted into the shredder head along a path along a plane askew to a plane generally defined by the bottom side of the shredder head housing, toward the at least some of the plurality of shredder blades, bracing the bottle during shredding, and exerting force on the bottle to maintain the bottle in contact with the at least some of the plurality of shredder blades during shredding of the bottle.

3. The method of claim 2, wherein the step of guiding the bottles inserted into the shredder head further comprises all of the plurality of shredder blades rotating about a single axis, the bottle being guided towards an interface between the at least some of the plurality of shredder blades and a stationary brace plate, the brace plate being located at a position relative to the single axis farther away than the maximum radius of any of the plurality of shredder blades and closer than a length of at least one shaft of the major blade, the brace plate defining a brace plate gap to allow the major blade to pass therethrough.

4. The method of claim 2, further comprising:

separating partially shredded pieces of the bottle above a predetermined size from the remaining shredded material for further shredding.

5. The method of claim 2, further comprising:

further shredding the partially shredded pieces until they are smaller than a predetermined size.

6. The method of claim 1, further comprising:

removing shredded bottles from the at least some of the plurality of shredder blades prior to the shredded bottles being carried past the lower half of the shredder blade rotation.

7. A method of shredding bottles, comprising:

providing a shredder head housing configured to receive bottles for shredding, the shredder head housing having a bottom side;

providing a plurality of shredder blades disposed within the shredder head housing adapted to shred bottles inserted therein;

providing a major blade rotatably located about a common axis with at least some of the plurality of shredder blades, the major blade comprises at least one shaft which extends radially outwardly from the common axis for a distance greater than the maximum radius of any of the plurality of shredder blades;

providing at least two guide plates located in the shredder head housing and oriented in an askew position relative to a plane generally defined by the bottom side of the shredder head housing and adapted to guide bottles towards the plurality of shredder blades, the at least two guide plates defining at least one guide plate gap through which the at least one shaft of the major blade passes during rotation;

providing at least two brace plates located in the shredder head housing and adapted to facilitate cutting which comprises a plurality of brace teeth which are at least partially interspersed with the shredder blades, the plurality of brace teeth allowing passage therebetween of the plurality of shredder blades, the at least two brace plates defining at least one brace plate gap through which the at least one shaft of the major blade passes during rotation; and engaging bottles via the major blade prior to the commencement of cutting by the plurality of shredder blades, the major blade at least one of cutting, deforming, and dragging bottles toward the plurality of shredder blades for shredding thereof.

8. The method of claim 7, further comprising the step of providing at least two grates located in the shredder head housing and oriented below the shredder blades, each grate comprising a mounting section and a sorting section defining a plurality of holes therethrough, the sorting section being located in close proximity to the plurality of shredder blades and being located to prevent larger pieces of shredded bottles from passing through the grate until shredded to a smaller size, the at least two grates defining at least one grate gap through which the at least one shaft of the major blade passes during rotation.

9. The method of claim 8, wherein the step of providing the at least two grates comprises a portion of the sorting section that forms the perimeter of the plurality of holes forming at least some sharpened edges.

10. A method of shredding bottles, comprising:

providing a shredder head housing configured to receive bottles for shredding, the shredder head housing having a bottom side;

providing a plurality of shredder blades disposed within the shredder head housing adapted to shred bottles inserted therein;

providing a major blade rotatably located about a common axis with at least some of the plurality of shredder blades, the major blade comprises at least one shaft which extends radially outwardly from the common axis for a distance greater than the maximum radius of any of the plurality of shredder blades;

providing at least two guide plates located in the shredder head housing and oriented in an askew position relative to a plane generally defined by the bottom side of the shredder head housing and adapted to guide bottles towards the plurality of shredder blades, the at least two guide plates defining at least one guide plate gap through which the at least one shaft of the major blade passes during rotation;

guiding bottles toward an interface between the at least some of the plurality of shredder blades and at least two brace plates, the at least two brace plates being located at a position relative to the common axis farther away than the maximum radius of any of the plurality of shredder blades and closer than a length of at least one shaft of the major blade, the at least two brace plates defining a brace plate gap to allow the major blade to pass therethrough; and engaging bottles via the major blade prior to the commencement of cutting by the plurality of shredder blades, the major blade at least one of cutting, deforming, and dragging bottles toward the plurality of shredder blades for shredding thereof.

11. The method of claim 10, further comprising:

guiding bottles inserted into the shredder head along a path along a plane askew to a plane generally defined by the bottom side of the shredder head housing, toward the at least some of the plurality of shredder blades, bracing the bottle during shredding, and exerting force on the bottle to maintain the bottle in contact with the at least some of the plurality of shredder blades during shredding of the bottle.

12. The method of claim 11, further comprising:

separating partially shredded pieces of the bottle above a predetermined size from the remaining shredded bottles for further shredding.

13. The method of claim 11, further comprising:

further shredding the partially shredded bottles until they are smaller than a predetermined size.

14. The method of claim 10, further comprising:

removing shredded bottles from the at least some of the plurality of shredder blades prior to the shredded bottles being carried past the lower half of the shredder blade rotation.

* * * * *